US009487910B2

(12) United States Patent
Huang et al.

(10) Patent No.: US 9,487,910 B2
(45) Date of Patent: Nov. 8, 2016

(54) CLOTHES DRYER AND CONTROL METHOD THEREOF

(71) Applicant: Hangzhou Sanhua Research Institute Co., Ltd., Hangzhou, Zhejiang (CN)

(72) Inventors: Linjie Huang, Zhejiang (CN); Yanhong Wang, Zhejiang (CN); Hongzhou Dong, Zhejiang (CN)

(73) Assignee: Hangzhou Sanhua Research Institute Co., Ltd., Zheliang (CN)

( * ) Notice: Subject to any disclaimer, the term of this patent is extended or adjusted under 35 U.S.C. 154(b) by 106 days.

(21) Appl. No.: 14/533,721

(22) Filed: Nov. 5, 2014

(65) Prior Publication Data

US 2015/0121718 A1 May 7, 2015

(30) Foreign Application Priority Data

Nov. 7, 2013 (CN) ..... 2013 1 0548897

(51) Int. Cl.
*D06F 58/28* (2006.01)
*D06F 58/20* (2006.01)

(52) U.S. Cl.
CPC ..... *D06F 58/28* (2013.01); *D06F 58/206* (2013.01); *D06F 2058/287* (2013.01); *D06F 2058/2829* (2013.01); *D06F 2058/2896* (2013.01)

(58) Field of Classification Search
CPC ..... D06F 58/00; D06F 58/06; D06F 58/28; F26B 21/00; F26B 21/06; F24F 1/02; F24F 3/153
USPC ..... 34/381, 413, 497, 595, 601, 606; 68/5 C, 5 R, 19, 20; 8/139, 149, 159; 62/79
See application file for complete search history.

(56) References Cited

U.S. PATENT DOCUMENTS 7,073,273 B2 * 7/2006 Kim ..... D06F 58/20 34/595
7,191,543 B2 * 3/2007 Yakumaru ..... D06F 58/206 34/77

(Continued)

FOREIGN PATENT DOCUMENTS

DE EP 0467188 A1 * 1/1992 ..... D06F 58/206
DE 102005041145 A1 3/2007

(Continued)

OTHER PUBLICATIONS

European Search Report; Application No. 14192005.8; Dated Mar. 25, 2015.

*Primary Examiner* — Stephen M Gravini
(74) *Attorney, Agent, or Firm* — Boyle Fredrickson, S.C.

(57) ABSTRACT

A clothes dryer and a control method thereof are provided. The clothes dryer includes an air circulation system and a refrigerant circulation system, the refrigerant circulation system includes a compressor, a condenser, a throttling element and an evaporator; the air circulation system includes a filter device, an air circulation power fan and a roller, and the refrigerant circulation system does not include a subcooler; the clothes dryer further includes a controller, a temperature sensor or a temperature-sensing element, and a temperature and humidity sensing element; the controller is configured to control an operation of the refrigerant circulation system, the operation of the clothes dryer includes a temperature rise phase and a basic drying phase, and the compressor of the clothes dryer is configured to have a higher power consumption in the temperature rise phase than in the basic drying phase, to rapidly rise a temperature in the clothes dryer.

19 Claims, 14 Drawing Sheets

(56) References Cited

U.S. PATENT DOCUMENTS

| | | | | |
|---|---|---|---|---|
| 7,322,123 | B2 * | 1/2008 | Tadano | D06F 58/206 34/77 |
| 7,325,333 | B2 * | 2/2008 | Tadano | D06F 58/206 34/604 |
| 7,469,486 | B2 * | 12/2008 | Tamura | D06F 58/02 34/474 |
| 7,908,766 | B2 * | 3/2011 | Ahn | D06F 58/206 126/21 A |
| 7,921,578 | B2 * | 4/2011 | McAllister | D06F 35/00 134/10 |
| 8,087,182 | B2 * | 1/2012 | Steffens | D06F 58/206 165/156 |
| 8,156,659 | B2 * | 4/2012 | Jung | D06F 58/20 198/810.02 |
| 8,484,862 | B2 * | 7/2013 | Nawrot | D06F 58/206 165/287 |
| 8,572,862 | B2 * | 11/2013 | Tegrotenhuis | F26B 23/005 165/164 |
| 8,578,626 | B2 * | 11/2013 | Steffens | D06F 58/206 134/198 |
| 8,627,581 | B2 * | 1/2014 | Brown | D06F 58/02 34/603 |
| 8,656,604 | B2 * | 2/2014 | Ediger | D06F 58/206 134/30 |
| 2015/0121718 | A1 * | 5/2015 | Huang | D06F 58/28 34/476 |

FOREIGN PATENT DOCUMENTS

| | | |
|---|---|---|
| EP | 1637641 A2 | 3/2006 |
| EP | 2586906 A1 | 5/2013 |

* cited by examiner

CLOTHES DRYER AND CONTROL METHOD THEREOF

The present application claims the benefit of priority to Chinese patent application No. 201310548897.7 titled "CLOTHES DRYER AND CONTROL METHOD THEREOF", filed with the Chinese State Intellectual Property Office on Nov. 7, 2013, the entire disclosure of which is incorporated herein by reference.

TECHNICAL FIELD

The present application relates to domestic appliance systems, and particularly relates to a clothes dryer and a control method thereof.

BACKGROUND

Existing clothes dryers mainly include air-vented clothes dryers, condenser clothes dryers, and heat pump clothes dryers. Compared with the air-vented clothes dryers and the condenser clothes dryers, the heat pump clothes dryers have advantages of energy conservation, environment protection and etc. A heat pump system of the heat pump clothes dryer includes a compressor, a condenser, a throttling element and an evaporator. Air for drying materials is driven by a fan to circulate. Firstly the air is heated by a high temperature condenser and enters into a roller to absorb moisture in the materials, thus the air has a high humidity. Then, the high-humidity air is cooled and dehumidified by a low temperature evaporator, and the condensate water formed in the above process is discharged through a drain system. The low-temperature and low-humidity air from the evaporator enters into the condenser to be heated, to become high-temperature and low-humidity air again, and then the high-temperature and low-humidity air enters into the roller to absorb moisture. The above circulation is repeated until the humidity of the material in the roller meets a requirement. In the drying process, with the discharging of the condensate water, the temperature of the materials becomes increasingly higher, and the moisture load in the materials becomes increasingly lower. In this case, if energy provided by a refrigerant system only changes slightly, the temperature of the air, which enters into the roller after being heated by the condenser, would become increasingly higher. Although the moisture absorption capability of the air increases as the air temperature in the roller increases, the materials may be broken by the high-temperature air. And, since the temperature of the air passing through the evaporator becomes increasingly higher, the evaporating pressure and the evaporating temperature becomes increasingly higher, and the suction pressure and the suction temperature of the compressor may also become increasingly higher, thus the discharge pressure and the discharge temperature of the compressor are increased. Therefore, for the heat pump clothes dryer, it is a main problem to control the temperature of the inlet air of the roller and the discharge temperature of the compressor in the drying process, and meanwhile, save energy as much as possible. Currently, some manufacturers address the above problem by providing a subcooler which is not involved in the air circulation system. The subcooler dissipates heat into the atmosphere for controlling the temperature of the inlet air of the roller, that is, to control the heat entering into the air circulation system. However, the heat dissipated into the atmosphere from the subcooler is wasted, causing a low energy utilization efficiency.

SUMMARY

An object of the present application is to provide a clothes dryer and a control method thereof, which may control heat entering into a roller to avoid waste of heat quantity.

To achieve the above object, a clothes dryer of the present application employs the following technical solutions. A clothes dryer includes an air circulation system and a refrigerant circulation system, the refrigerant circulation system includes a compressor, a condenser, a throttling element and an evaporator, the air circulation system includes a filter device, an air circulation power fan for supplying power of air circulation of the air circulation system, and a roller for accommodating objects to be dried; the condenser is configured to provide heat quantity, required for drying, to the roller; the clothes dryer further includes a controller, a temperature sensor or a temperature-sensing element, and a temperature and humidity sensing element; the controller is configured to control an operation of the clothes dryer, which includes controlling an operating condition of the refrigerant circulation system; the operation of the clothes dryer includes a temperature rise phase and a basic drying phase, and the compressor of the clothes dryer is configured to have a higher power consumption in the temperature rise phase than in the basic drying phase.

To achieve the above object, a control method of a clothes dryer in the present application employs the following technical solutions. A control method of a clothes dryer, comprising: providing a clothes dryer comprising an air circulation system and a refrigerant circulation system, the refrigerant circulation system comprising a compressor, a condenser, a throttling element and an evaporator, the air circulation system comprising a filter device, an air circulation power fan for supplying power of air circulation of the air circulation system, and a roller for accommodating objects to be dried; providing the refrigerant circulation system which does not comprise a subcooler; the condenser is configured to provide heat quantity, required for drying, to the roller, the clothes dryer further comprises a controller, a temperature sensor or a temperature-sensing element, and a temperature and humidity sensing element; the controller is configured to control an operation of the clothes dryer, which comprises controlling an operating condition of the refrigerant circulation system; the operation of the clothes dryer comprises a temperature rise phase and a basic drying phase, and the compressor of the clothes dryer is configured to have a higher power consumption in the temperature rise phase than in the basic drying phase; providing the compressor which is a variable speed compressor, the compressor of the clothes dryer is configured to have a higher rotational speed in the temperature rise phase than in the basic drying phase, to enable the compressor of the clothes dryer to have a higher power consumption in the temperature rise phase than in the basic drying phase; the rotational speed of the compressor operating in the temperature rise phase is a maximum value of the rotational speed of the compressor in the entire operation of the clothes dryer, and the rotational speed of the compressor is substantially unchanged in the temperature rise phase; and in the basic drying phase, the rotational speed of the compressor is controlled, by the controller, according to at least one of a temperature of inlet air of the roller, a condensing temperature of the condenser, and a discharge temperature of the compressor, or providing the compressor which is a fixed-frequency compressor, and the throttling element is an electronic expansion valve, an opening of the electronic expansion valve is adjusted to enable the compressor of the clothes dryer to have a higher power consumption in the temperature rise phase than in the basic drying phase in which outlet air of the roller has a relatively stable humidity; in the temperature rise phase of the clothes dryer, the controller sends a control signal to the electronic expansion valve, to require the electronic expansion valve to have a larger opening than in the basic drying phase of the clothes dryer; in the temperature rise phase, the opening of the electronic expansion valve is the maximum opening in the entire operation of the clothes dryer, and in the temperature rise phase, the control signal sending to the electronic expansion valve from the controller requires the electronic expansion valve to have a substantially unchanged opening; and in the basic drying phase, the opening of the electronic expansion valve is controlled, by the controller, according to at least one of a temperature of inlet air of the roller, a condensing temperature of the condenser, and a discharge temperature of the compressor.

Compared to the conventional technology, the present application may control the refrigerant flow of the compressor by controlling the rotational speed of the compressor or the opening (or flow) of the electronic expansion valve, thereby controlling the heat quantity entered into the roller, and controlling the air temperature in each phase of the clothes dryer. Further, the air temperature of the clothes dryer may rise rapidly, which reduces the energy consumption in the drying process. The clothes dryer does not need a subcooler, which saves the energy in the drying process.

DETAILED DESCRIPTION

Figure 1:
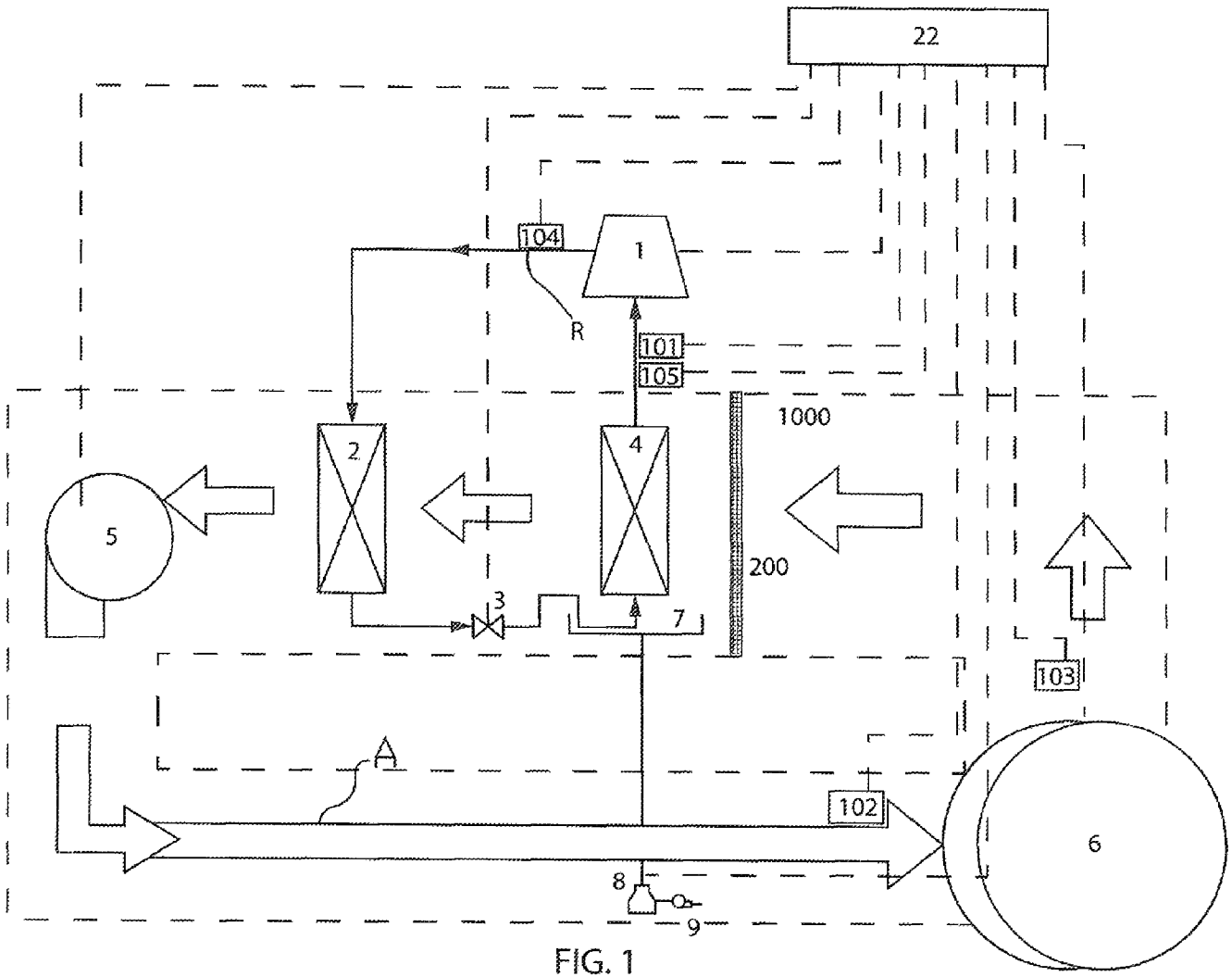
FIG. 1 is a schematic view of a clothes dryer according to a first embodiment of the present application.
Figure 2:
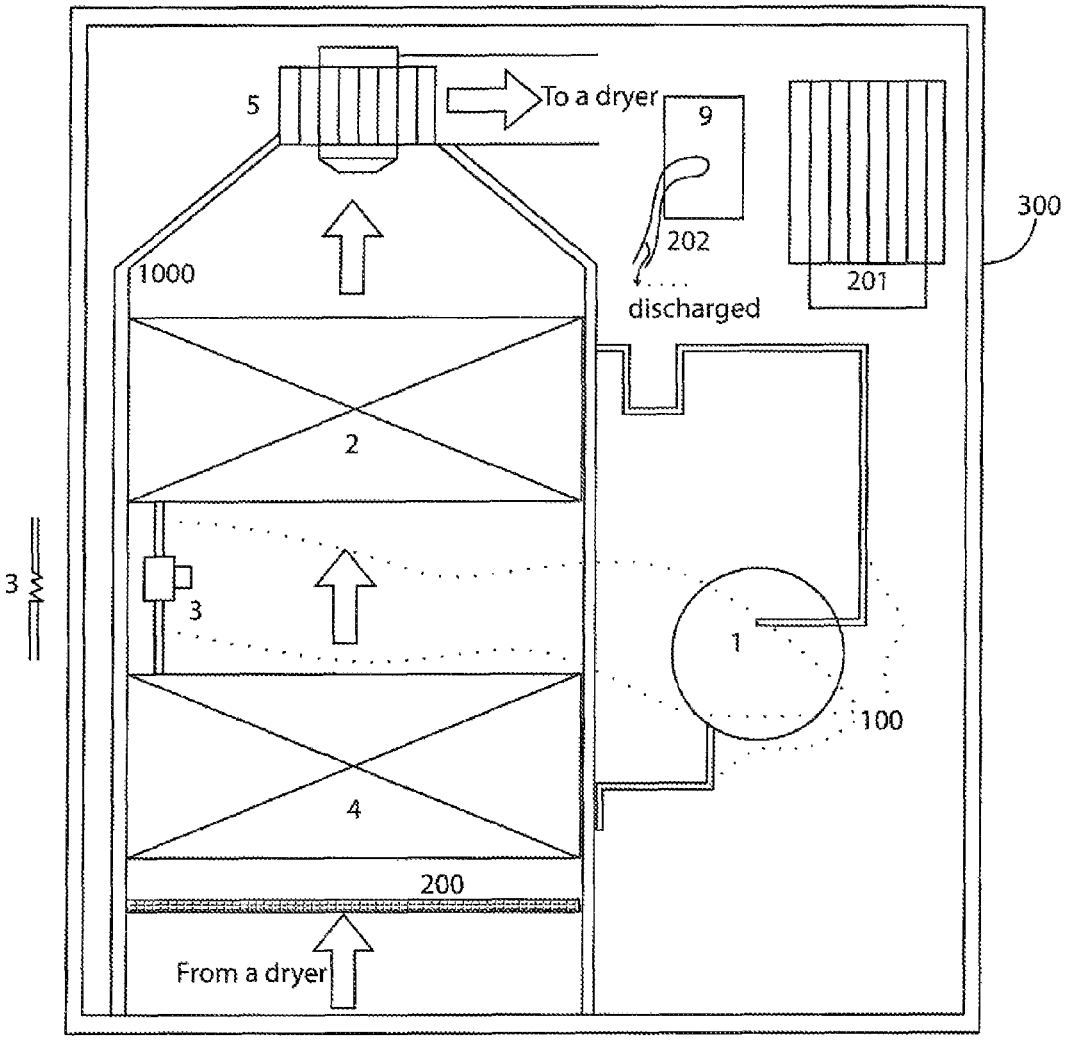
FIG. 2 is a schematic view of a bottom of the clothes dryer (with a roller removed) according to the first embodiment of the present application.
Figure 3:
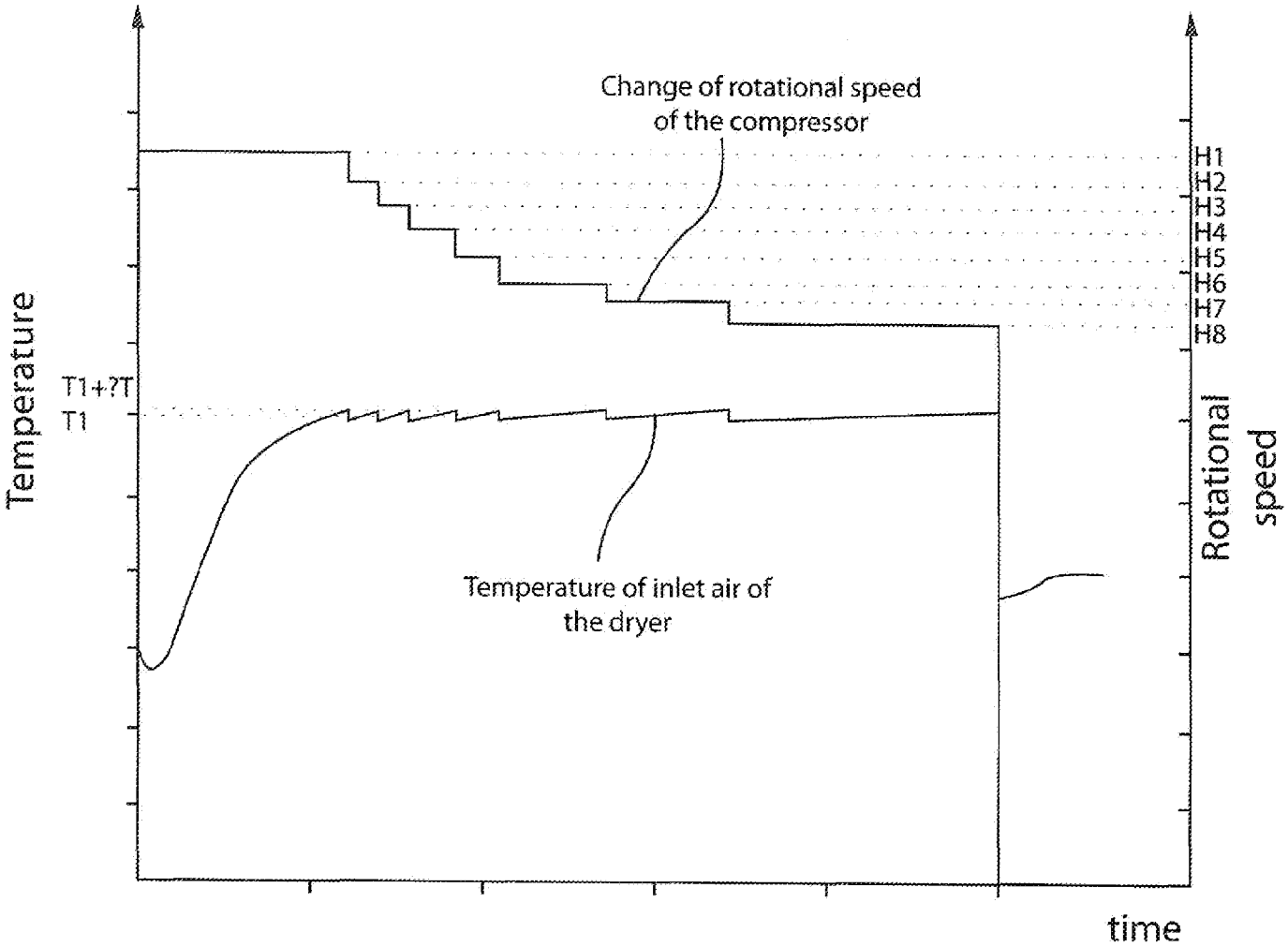
FIG. 3 is a schematic view of several parameters of the clothes dryer in the operation according to the first embodiment of the present application.
Figure 4:
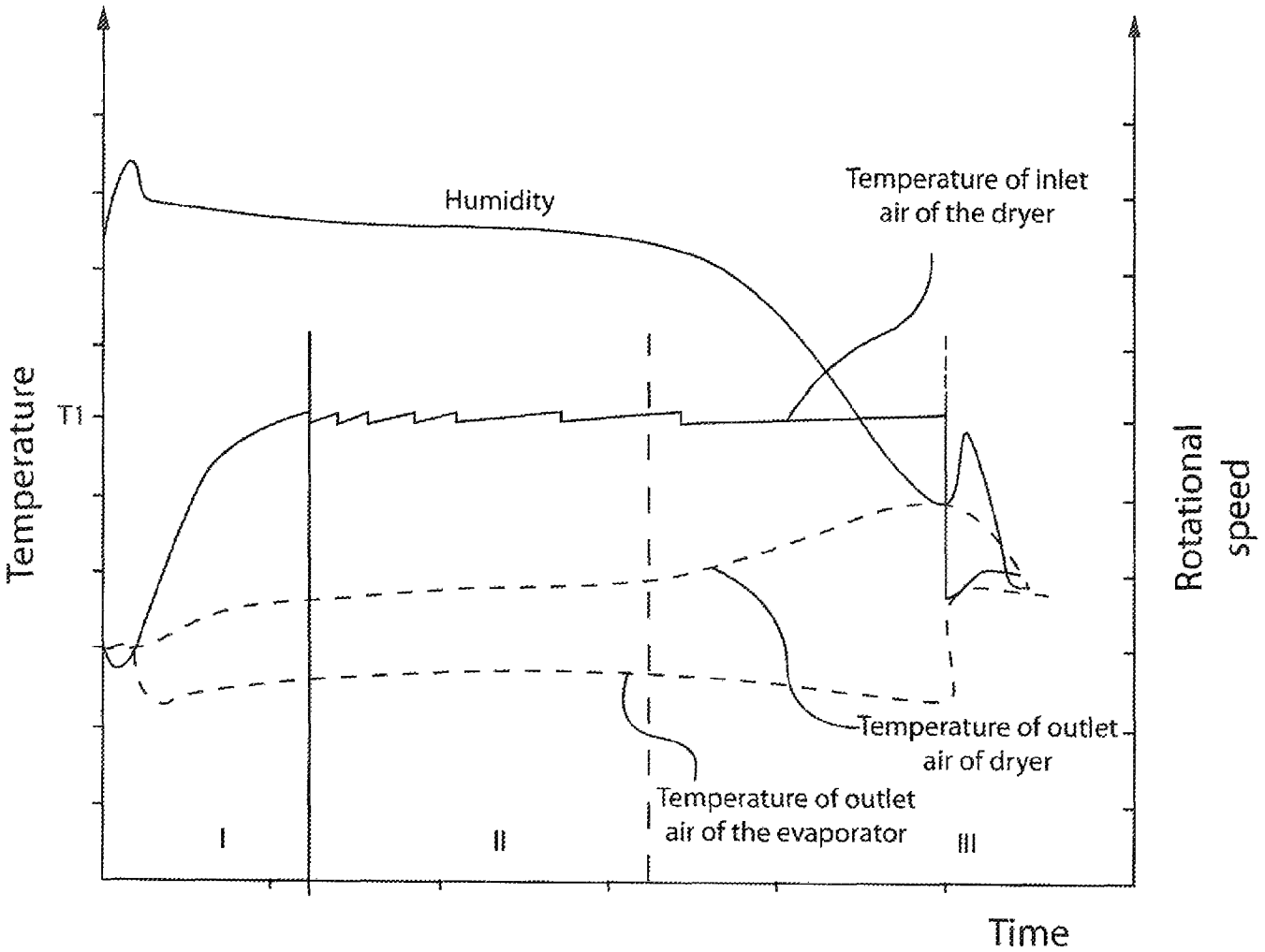
FIG. 4 is a schematic view of other parameters of the clothes dryer in the operation according to the first embodiment of the present application.
Figure 5:
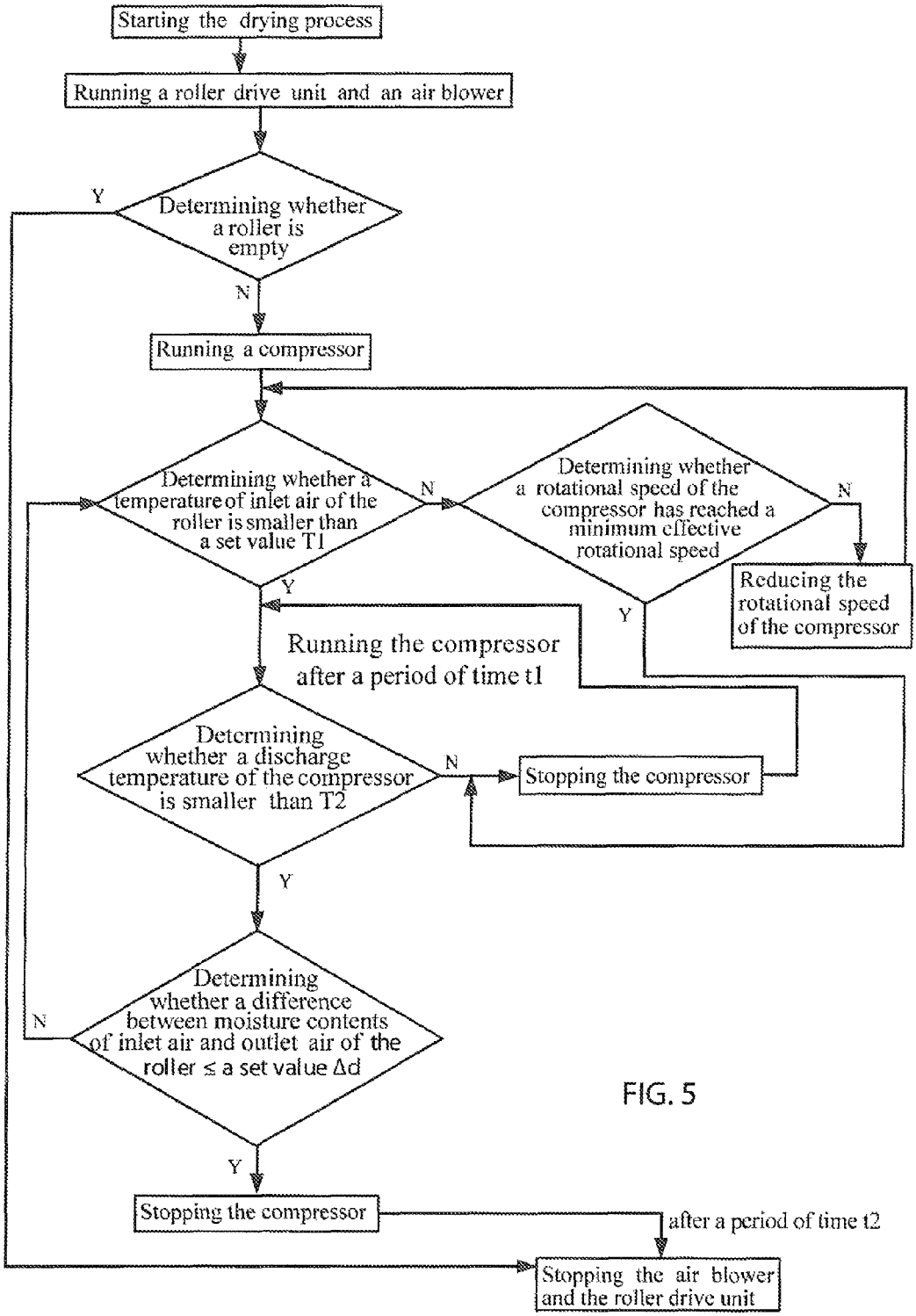
FIG. 5 is a control flow chart of the clothes dryer in the first embodiment.
Figure 11:
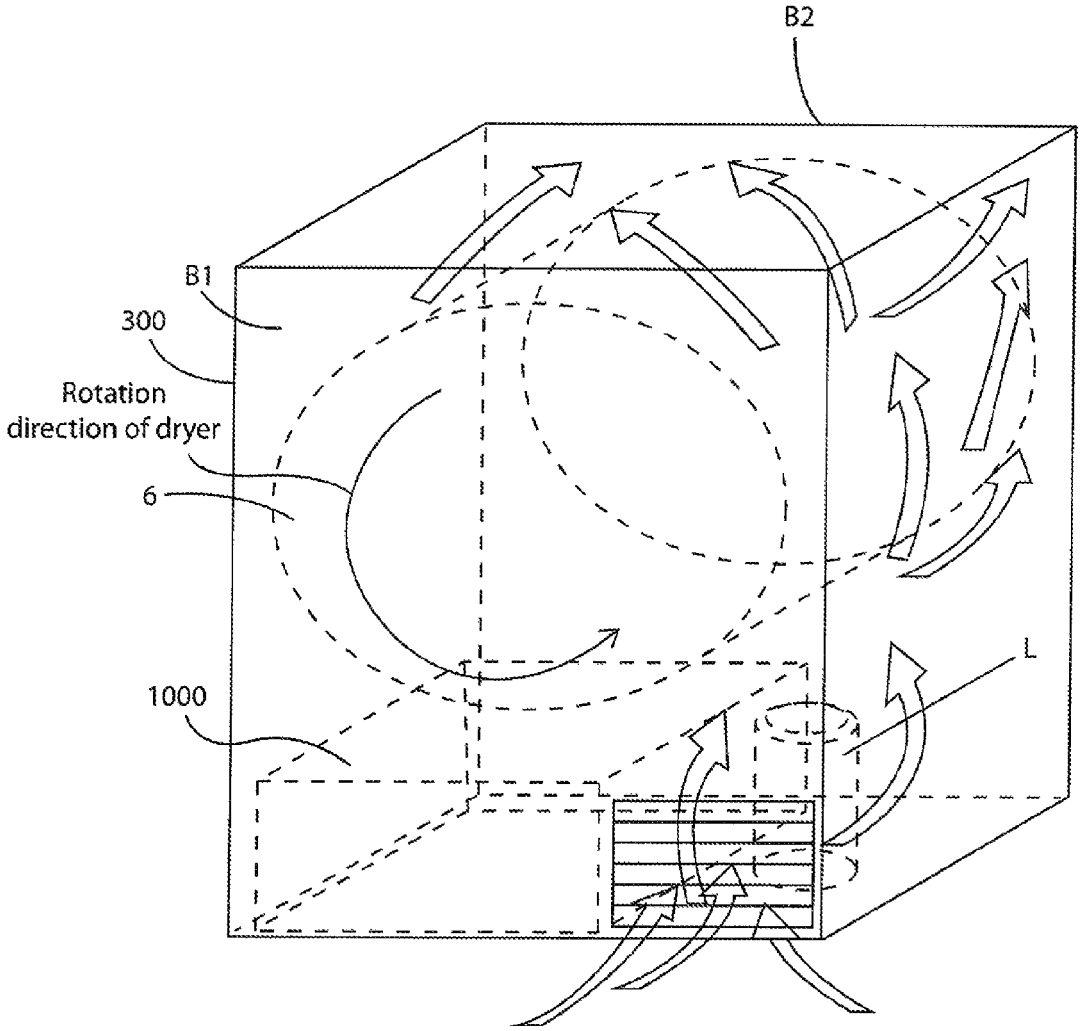
FIG. 11 is an overall schematic view of the clothes dryer.

The embodiments of the present application are described hereinafter in conjunction with the drawings. FIG. 1 is a schematic view of a clothes dryer according to a first embodiment of the present application. FIG. 2 is a schematic view showing the interior of the clothes dryer according to the first embodiment of the present application, wherein a bottom casing at a bottom area of the clothes dryer and a roller are removed to illustrate the internal arrangement of the clothes dryer. FIG. 3 and FIG. 4 are schematic views of parameters of the clothes dryer in the operation according to the first embodiment. FIG. 5 is a control flow chart of the clothes dryer in the first embodiment. FIG. 11 is an overall schematic view of the clothes dryer, wherein an air circulation manner is illustrated. In the figures, reference numeral B1 indicates a front wall of the clothes dryer, reference numeral B2 indicates a rear wall of the clothes dryer, and reference numeral 202 indicates a drain pipe connected to a draining pump of a condenser, and reference numeral 201 indicates a motor for providing power to rotate the roller, and reference numeral 100 indicates connecting pipes for connecting a throttling element 3, an evaporator, the condenser and the compressor.

The clothes dryer includes an air circulation system A and a refrigerant circulation system R. The refrigerant circulation system R includes a compressor 1, a condenser 2, the throttling element 3, and an evaporator 4. In this embodiment, the compressor is a variable speed compressor. The air circulation system A includes an air-conditioning box 1000, a filter device 200, an air circulation power fan 5, a roller 6, a water pan 7 for condensate water, a water container 8, and a condensate water pump 9 and etc. In addition, the clothes dryer further includes a controller 22, several temperature sensors, temperature and humidity sensors 102 and 103, a pressure sensor, and etc. The air-conditioning box 1000 includes the condenser 2, the throttling element 3, and the evaporator 4. In this embodiment, the compressor is a variable speed compressor, and the throttling element of the refrigerant circulation system R may employ an electronic expansion valve, a thermal expansion valve or employ a capillary for throttling.

The operation of the refrigerant circulation system R is described as follows. A low-temperature and low-pressure refrigerant gas is sucked into the variable speed compressor 1 to be compressed, thereby turning into a high-temperature and high-pressure gas which then enters into the condenser 2 and is cooled by a relatively cold air outside the condenser 2, while the air is heated. Then, after being throttled by the capillary/expansion valve 3, the refrigerant gas turns into a low-temperature and low-pressure gas-liquid two-phase refrigerant, and then enters into the evaporator 4, the refrigerant absorbs heat to turn into a low-temperature and low-pressure refrigerant gas, and at the same time, cools the air which exchanges heat through the evaporator 4. Thus, the water vapor in the air is condensed, which reduces the humidity of the air. The refrigerant gas from the evaporator 4 enters into the variable speed compressor 1 again to be compressed, and the circulation is repeated.

The operation of the air circulation system A is described as follows. The high-temperature and low-humidity air, which is heated when passing through the condenser 2, enters into the roller 6 to exchange heat with clothes in the roller 6 and absorb the moisture in the clothes to be dried in the roller 6, and then turns into a high-temperature and high-humidity air. Then, the high-temperature and high-humidity air passes through a filter device 200 to remove cotton fibers, and then is conveyed into the evaporator 4 to be cooled and dewatered, thereby turning into a low-temperature and low-humidity air. The low-temperature and low-humidity air is heated again when passing through the condenser 2 to turn into a high-temperature and low-humidity air which then enters into the roller 6 again. Thus the air circulation is repeated to complete the drying process. In this operation, condensate water generated by the air passing through the evaporator 4 flows into the water pan 7, then flows into the water container 8, and then is discharged by the condensate water pump 9.

In the refrigerant circulation system R, the temperature of inlet air of the roller may be controlled by using a combination of the variable speed compressor and the capillary throttling, or by using a combination of the variable speed compressor and the expansion valve. The capillary throttling cannot control the flow of the refrigerant, thus a superheat degree of suction gas of the compressor cannot be controlled. The manner using the expansion valve for throttling may control the superheat degree of the suction gas of the compressor, thus may control the temperature of the inlet air of the roller in a case that the compressor has a higher frequency, thereby further saving energy.

FIG. 3 is a schematic view showing a changing process of a rotation speed of the compressor in the drying process, in which a step adjustment of the rotation speed of the compressor from high to low is performed to control the temperature of the inlet air of the roller. In the figure, reference numerals H1, H2, H3, H4, H5, H6, H7 and H8 indicate rotation speeds of the compressor of the clothes dryer in the operation, wherein, H1>H2>H3>H4>H5>H6>H7>H8. The drying process of the clothes dryer includes a temperature rise phase I, a basic drying phase II, a post-drying phase III. The temperature rise phase I is a temperature rise phase of the drying circulation air, and the phase ends when the temperature of the circulation air entered into the roller reaches a required temperature T1. The basic drying phase II is a main drying phase, in which the outlet air of the roller has a relatively stable humidity after the temperature rise phase I. The post-drying phase III is a phase that the humidity of the outlet air of the roller is decreased rapidly until the humidity of the clothes meets the requirement. The post-drying phase III may be set as needed, for example, the post-drying phase III may be omitted if the clothes need to be ironed. In addition, the basic drying phase II and the post-drying phase III may be combined as a drying phase, and the end time of the drying process may be determined as needed, for example may be controlled according to the humidity of the outlet air of the roller. FIG. 4 is a schematic view showing variations of the temperature of the inlet air of the roller, the humidity of the outlet air of the roller, the temperature of the outlet air of the roller, and the temperature of the outlet air of the evaporator in each phase of the clothes dryer in the drying process. A change rate of the temperature or the humidity of the outlet air of the roller may be used to differentiate the basic drying phase from the post-drying phase. For example, when the humidity of the outlet air is below a certain value, the clothes dryer enters into the post-drying phase, and the humidity of the outlet air in the basic drying phase is higher than the humidity of the outlet air in the post-drying phase. For another example, when the clothes dryer enters into the post-drying phase after the basic drying phase, the change rate of the humidity of the outlet air is increased, and the rotation speed of the compressor in the basic drying phase is greater than the rotation speed thereof in the post-drying phase.

In the temperature rise phase I, the rotation speed H1 of the compressor 1 is a maximum value in each phase of the operation of the clothes dryer. The maximum value of the rotation speed of the compressor 1 herein refers to an allowable value under a certain condition which is determined in the system or a maximum operating value allowed by the controller. The value may be varied with the type of the clothes dryer, the temperature of the environment, and is not a maximum value of the speed that the compressor can reach. Thus, the temperature of the inlet air of the roller 6 may rapidly reach a temperature required in a stable drying phase. When the temperature of the inlet air of the roller reaches a set value of T1, T1+ΔT1 or T1−ΔT1, the rotation speed of the compressor is reduced to H2, which reduces the flow of the refrigerant flowing out of the compressor, thus heat transferred to the air from the condenser 2 is correspondingly reduced, and the temperature of the inlet air of the roller 6 may be reduced instantly. As the drying process continues, the temperature of the inlet air of the roller may continue to increase, and when the temperature of the inlet air of the roller reaches a determined value of T1+ΔT2, the rotation speed of the compressor is reduced to H3, thereby controlling the temperature of the outlet air of the roller. That is, the rotation speed of the compressor in the temperature rise phase I is greater than the rotation speed of the compressor in the basic drying phase II in which the outlet air of the roller has a relatively stable humidity, and the rotation speed of the compressor in the basic drying phase II in which the outlet air of the roller has the relatively stable humidity is greater than or equal to the rotation speed of the compressor in the post-drying phase III in which the outlet air of the roller is reduced. With such adjustment of the rotation speed of the compressor, the temperature of the outlet air of the roller may be effectively controlled, which relatively shortens the temperature rise process, and also effectively avoids a waste of energy when heat is dissipated into the atmosphere in the temperature rise phase and the drying phase. Compared with a conventional heat pump dryer, the clothes dryer in the present application saves energy and reduces the number of the components, and the time of the entire drying process may also be shortened, wherein, a range of ΔT1 is 5° C.≥ΔT1≥0° C., and a range of ΔT2 is 2° C.≥ΔT1≥0.5° C. In addition, the rotation speed in the temperature rise phase may be variable, for example, the temperature rise phase may include two or more rotation speeds. The meaning of "the outlet air of the roller having a relatively stable humidity in the basic drying phase II" does not refer to that the humidity is constant, but refers to that the changing of the humidity has a small range and a slow speed, for example, the time required for the humidity changing from 80% to 60% slowly in the basic drying phase II is longer than the time required for the humidity changing from 60% to 15% slowly in the post-drying phase III.

A control flow of the clothes dryer is described hereinafter in conjunction with FIG. 5. Reference is made to FIG. 5, the compressor employs the step speed adjustment and the capillary is used for throttling. The compressor may also employ stepless speed adjustment, and an action temperature is T1 or T1±ΔT, wherein 2° C.≥ΔT1≥0° C. The control flow may include the following processes.

S1 may include starting a clothes dryer and running a roller drive unit and an air blower.

S2 may include determining whether a roller is empty according to a signal transmitted to a controller 22 from the roller, stopping the air blower and the roller drive unit in a case that the roller is empty; proceeding to S3 in a case that the roller is not empty. The signal from a loaded roller is different from the signal from an unloaded roller, and a rotational inertia of the roller or a temperature difference between inlet air and outlet air of the roller may be used to determine whether the roller is empty.

S3 may include running a compressor, and proceeding to S4.

S4 may include determining, by the controller 22, whether a temperature of the inlet air of the roller is smaller than a set value T1, T1+ΔT or T1−ΔT according to a temperature value of the inlet air of the roller which is detected by a temperature sensor, such as a temperature and humidity sensor 102 or a separately arranged thermocouple; proceeding to S5 in a case that the temperature of the inlet air of the roller is smaller than the set value T1, T1+ΔT or T1−ΔT; proceeding to S7 in a case that the temperature of the inlet air of the roller is not smaller than the set value T1, T1+ΔT or T1−ΔT.

S5 may include determining, by the controller 22, whether a discharge temperature of the compressor is smaller than a set value T2, wherein the discharge temperature of the compressor is detected by a temperature sensor, such as a thermocouple 104; proceeding to S6 in a case that the discharge temperature is smaller than the set value T2; proceeding to S8 in a case that the discharge temperature is not smaller than the set value T2.

S6 may include obtaining, by the controller 22, absolute moisture contents of the inlet air and the outlet air of the roller according to measured values from the temperature and humidity sensors 102 and 103; determining whether a difference between the absolute moisture contents of the inlet air and the outlet air of the roller is smaller than a set value Δd; proceeding to S4 in a case that the difference between the absolute moisture contents of the inlet air and the outlet air of the roller is not smaller than the set value Δd; stopping the compressor in a case that the difference between the absolute moisture contents of the inlet air and the outlet air of the roller is smaller than the set value Δd, and stopping the air blower and the roller drive unit after the compressor has been stopped for a period of time t2.

S7 may include determining, by the controller 22, whether a real-time rotational speed of the compressor has reached a minimum effective rotational speed; lowering the rotational speed of the compressor in a case that the real-time rotational speed of the compressor has not reached the minimum effective rotational speed, and proceeding to S4 after a period of time elapses; proceeding to S8 in a case that the real-time rotational speed of the compressor has reached the minimum effective rotational speed.

S8 may include stopping the compressor, and running the compressor after a period of time t1 elapses, and proceeding to S5.

In the above embodiment, the temperature sensor for detecting the temperature of the inlet air of the roller may be positioned in an air duct between an outlet of the condenser of the air circulation system and the inlet of the roller; the temperature and humidity sensors 102 and 103 for measuring the absolute moisture contents or relative humidities of the inlet air and the outlet air of the roller may be positioned at the inlet and the outlet of the roller, respectively; and the temperature sensor 104 for measuring the discharge temperature of the compressor may be positioned at the outlet pipe of the compressor. In addition, step S2 may be performed or omitted according to the system situation, that is, the clothes dryer may directly operate after being turned on without performing the determination. In the temperature rise phase, the rotational speed of the compressor may be in a range of 40%-98% of the allowable maximum speed, for example, when the compressor operates at a frequency of 60 Hz, it operates at 50% of the maximum frequency 120 Hz. And in the basic drying phase, the rotational speed of the compressor may be adjusted according to a temperature difference between a practical temperature T0 of the inlet air of the roller and a set value T1. The greater the value of T0 minus T1, the greater the magnitude of the adjustment. For example, the following adjustment may be made.

(1) when the value of T0 minus T1 ranges from 0° C. to 2° C., the rotational speed of the compressor remains unchanged;

(2) when the value of T0 minus T1 ranges from 2° C. to 5° C., the rotational speed of the compressor is reduced by 1% to 10% of the current operating value;

(3) when the value of T0 minus T1 ranges from 5° C. to 10° C., the rotational speed of the compressor is reduced by 10% to 40% of the current operating value;

(4) when the value of T0 minus T1 is greater than 10° C., the system indicates an error, and the system is stopped; and (5) when T0 is smaller than T1, the system remains the rotational speed of the compressor unchanged.

After each adjustment, the controller processes the received temperature signal and pressure signal at an interval of 0.5 s to 5 s (preferably, the interval ranges from 1 s to 3 s) and provides a feedback, to determine whether the system is in a stable state. A duration required for the stable state may be stored in the system by system experiments, and preferably, the duration ranges from 2 s to 30 s.

In the above control process, a range of T1 is 50° C.≤T1≤70° C., a range of T2 is 80° C.≤T2≤120° C., a range of a duration t1 that the compressor is not working is 1 min≤t1≤5 min, and a range of t2 is 1 min≤t2≤5 min. The above values may be selected according to the type of the clothes dryer and a quantity of the clothes. The difference Δd of moisture contents of the inlet air and the outlet air of the roller may be selected according to a drying degree. For example, the drying degrees of the clothes to be ironed after drying and the clothes not to be ironed after drying are different, thus the standards for determining whether the drying process should be stopped are also different, that is, the post-drying phase may be omitted when the clothes is to be ironed after drying.

The minimum effective rotational speed in the rotational speed adjustment of the compressor 1 is a rotational speed at which the compressor operates to enable the evaporating temperature of the evaporator 4 to be smaller than or equal to a dew-point temperature of the outlet air of the roller, and the minimum effective rotational speed is not the minimum rotational speed that the compressor is able to operate, but may be a set value, for example, a set value in the direct control manner of the above control process. The minimum effective rotational speed may also be as a real-time value which varies with the operation condition, that is, a value in an indirect control manner. In addition, the above control process may be replaced by other control processes. For example, step S7 may be replaced by the following steps: positioning a temperature sensor, such as a thermocouple, at a surface of a middle pipe of the evaporator, comparing a temperature T0 detected by the temperature sensor and a dew-point temperature Tw of the outlet air of the roller detected and calculated by the temperature and humidity sensor at the outlet of the roller; proceeding to S8 in a case that a value of the temperature detected by the sensor at the surface of the evaporator minus the dew-point temperature of the outlet air of the roller is larger than or equal to ΔT'; otherwise, lowering the rotational speed of the compressor, and then proceeding to S4. In this case, the determination of "whether the rotational speed of the compressor has reached the minimum effective speed" is changed to the determination of "whether a value of T0 minus Tw is larger than or equal to ΔT'", wherein a range of ΔT' is 0≤ΔT'≤10° C.

Preferably, a range of T1 is 55° C.≤T1≤65° C., a range of T2 is 95° C.≤T2≤100° C., a range of t1 is 3 min≤t1≤5 min. a range of t2 is 2 min≤t2≤4 min, and a range of ΔT' is 0≤ΔT'≤5° C.

Relevant parameters in the control process may be stored in the control program by calibration, thus the compressor 1 may operate at different rotational speeds in different phases, and the temperature and flow at the outlet of the compressor may be controlled based on different values in different phases of the operation of the clothes dryer, and in this way, the temperature of the inlet air of the roller 6 may be controlled. When the temperature of the inlet air of the roller is higher than a set temperature value, the rotational speed of the compressor is reduced, thus the refrigerant flow is reduced, the heating quantity for the air provided by the condenser 2 is reduced, and the temperature of the inlet air of the roller is also reduced, and meanwhile the power of the compressor is reduced. Thus, compared to the heat pump clothes dryer widely used in the current market, the clothes dryer in the present application may effectively control the temperature of the inlet air of the roller without wasting energy.

Figure 6:
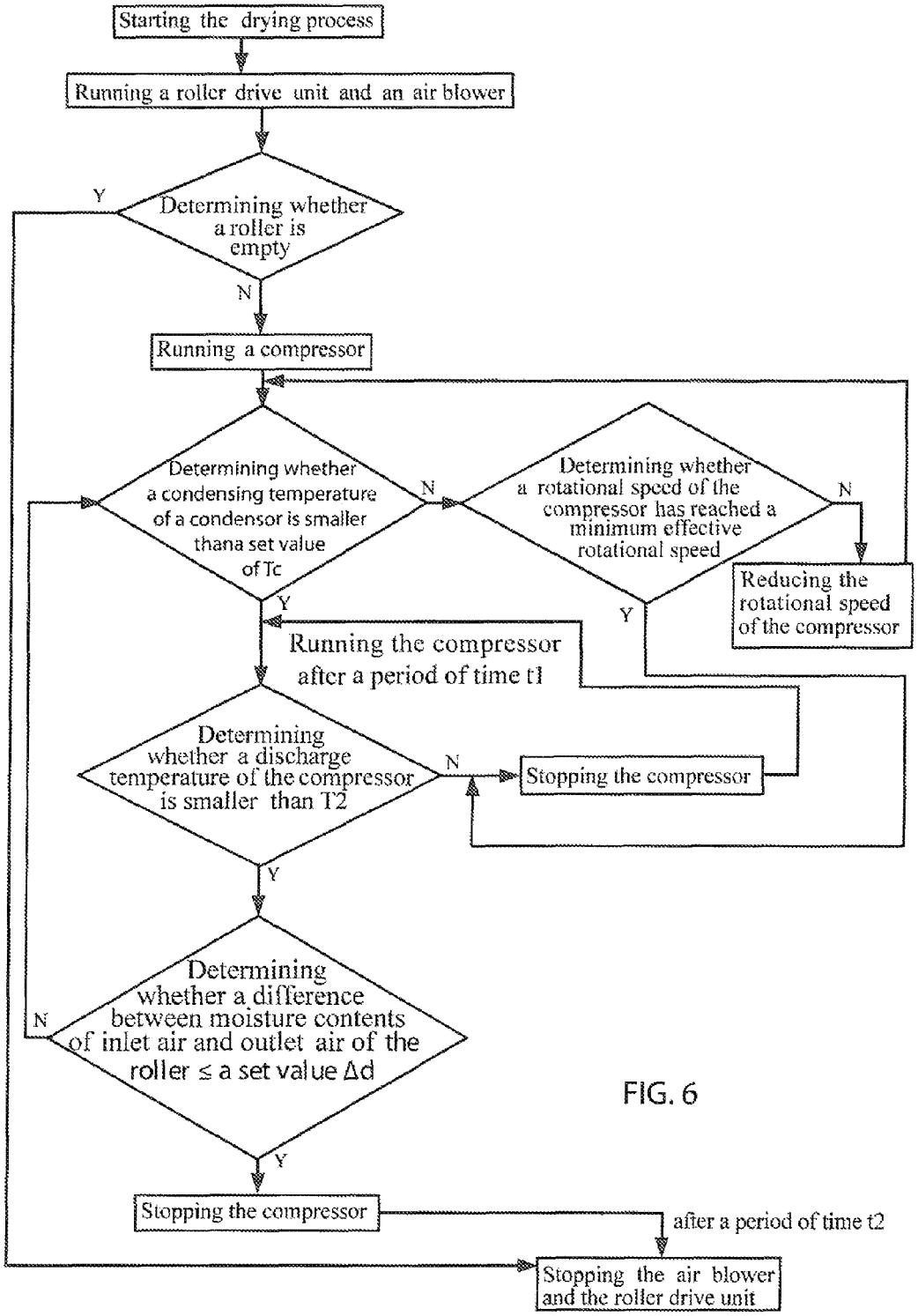
FIG. 6 is another control flow chart of the clothes dryer in the first embodiment.

In the above solution, the rotational speed of the variable speed compressor is adjusted by directly detecting the temperature of the inlet air of the roller, so as to control the temperature of the inlet air of the roller. In addition, the temperature of the inlet air of the roller may be controlled indirectly by controlling the condensing temperature of the condenser, and in this case, the temperature sensor is positioned at an outer surface of the middle pipe wall of a main body of the condenser. In the above control process, the determination of "whether the temperature of the inlet air of the roller is smaller than a set value T1" is changed to the determination of "whether the condensing temperature of the condenser is smaller than Tc", and the flow chart is shown in FIG. 6. The set temperature Tc is in a range of 50° C.≤Tc≤75° C., and preferably, in a range of 55° C.≤Tc≤70° C. Step S4 in this control flow is different from step S4 in the control process shown in FIG. 5. This control flow includes the following step S4'.

S4' may include obtaining, by the controller 22, a condensing temperature value of the condenser which is detected by the thermocouple; and determining, by the controller 22, whether the condensing temperature value of the condenser is smaller than the set value Tc; proceeding to S5 in a case that the condensing temperature value of the condenser is smaller than the set value Tc; proceeding to S7 in a case that the condensing temperature value of the condenser is not smaller than the set value Tc.

Figure 7:
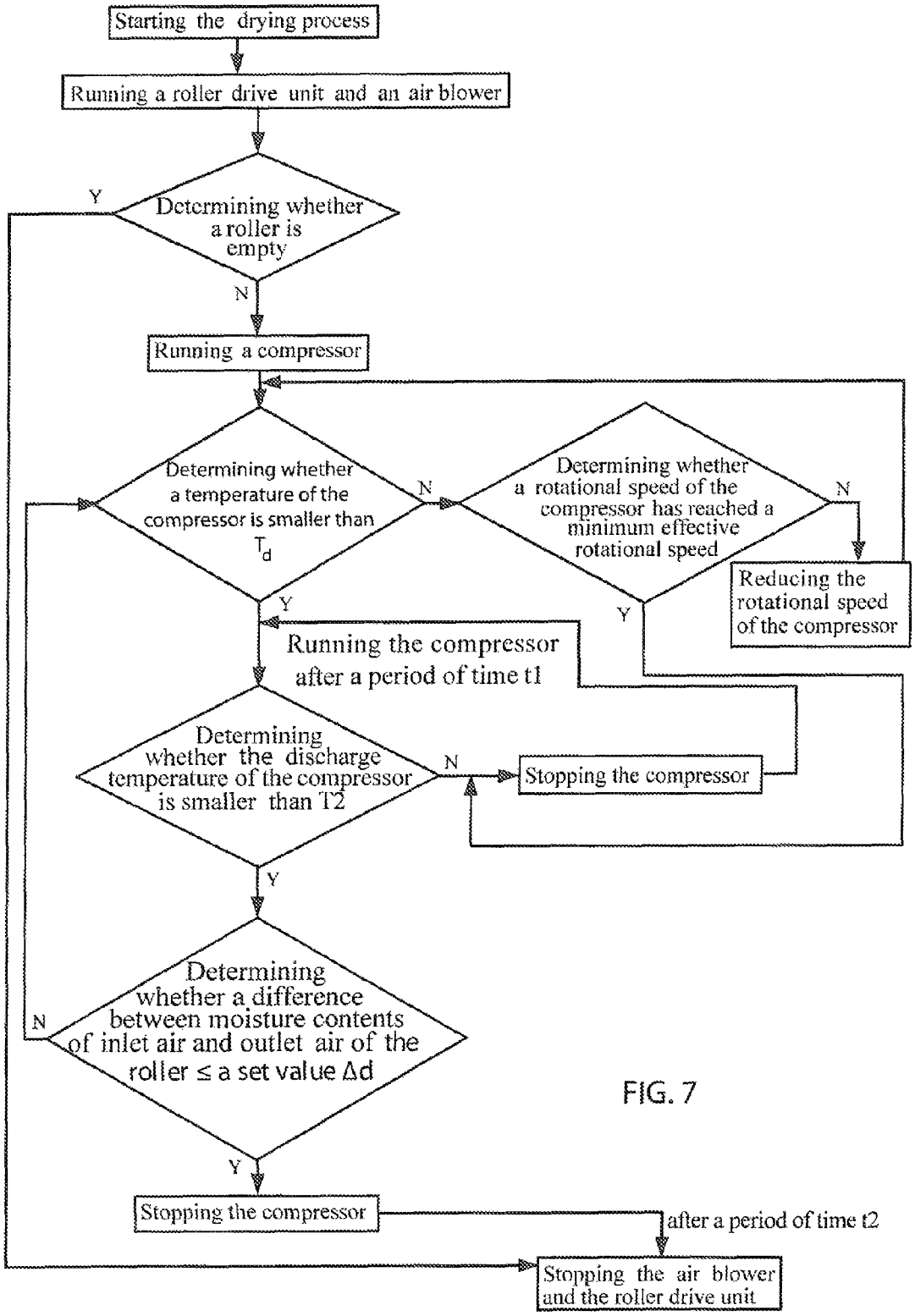
FIG. 7 is another control flow chart of the clothes dryer in the first embodiment.

In addition, the step S4 may also be replaced by step S4" in FIG. 7.

S4" may include obtaining, by the controller 22, a discharge temperature of the compressor which is detected by a temperature sensor, such as a thermocouple positioned on an outer surface of a discharging pipe wall of the compressor, and determining, by the controller 22, whether the discharge temperature of the compressor is smaller than a set value Td; proceeding to S5 in a case that the discharge temperature of the compressor is smaller than the set value Td; proceeding to S7 in a case that the discharge temperature of the compressor is not smaller than the set value Td.

In the above control process, the compressor is a variable speed compressor. The compressor may also be other types of variable speed compressors, for example, a switched reluctance compressor and etc. In addition, the throttling element may also be an expansion valve, for example, a thermal expansion valve or an electronic expansion valve.

Figure 8:
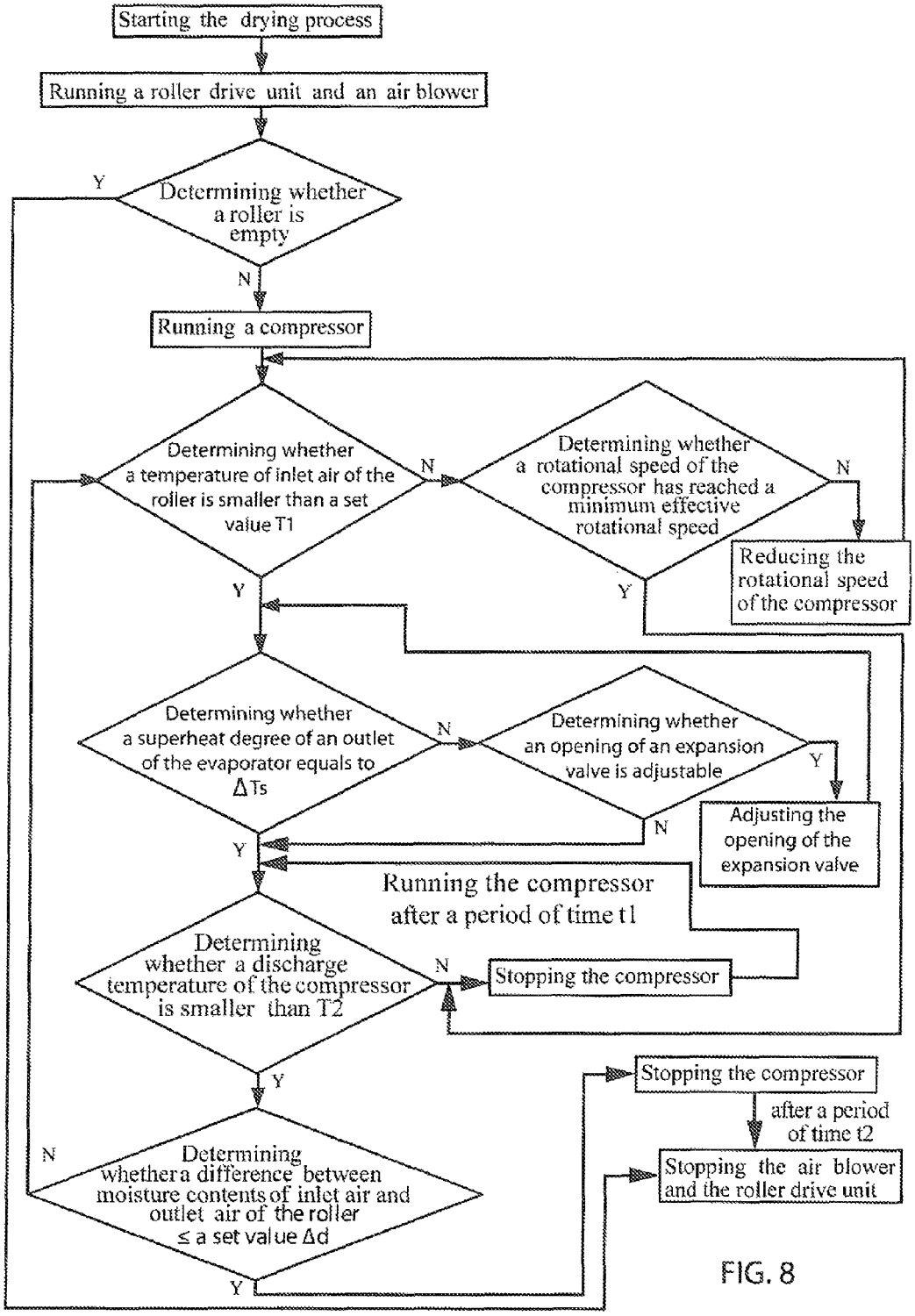
FIG. 8 is a control flow chart of the clothes dryer in the first embodiment, wherein a variable speed compressor and an expansion valve are used in system control.

The control flow in FIG. 8 is a flow chart showing a control process using the variable speed compressor in cooperation with an electronic expansion valve. The control process may include the following steps.

S01 may include starting the clothes dryer, and running a roller drive unit and an air blower.

S02 may include determining whether a roller is empty according to a signal transmitted to a controller 22 from the roller, stopping the air blower and the roller drive unit in a case that the roller is empty; proceeding to S03 in a case that the roller is not empty. The signal from a loaded roller is different from the signal from an unloaded roller, and a rotational inertia of the roller or a temperature difference between inlet air and outlet air of the roller may be used to determine whether the roller is empty.

S03 may include running a compressor, and proceeding to S04.

S04 may include determining, by the controller 22, whether a temperature of the inlet air of the roller is smaller than a set value T1, T1+ΔT or T1−ΔT according to a temperature value of the inlet air of the roller which is detected by a thermocouple or a temperature and humidity sensor; proceeding to S05 in a case that the temperature of the inlet air of the roller is smaller than the set value T1, T1+ΔT or T1−ΔT; proceeding to S08 in a case that the temperature of the inlet air of the roller is not smaller than the set value T1, T1+ΔT or T1−ΔT.

S05 may include determining whether a superheat degree of an outlet of the evaporator equals to ΔTs; proceeding to S06 in a case that the superheat degree equals to ΔTs; proceeding to S10*a* in a case that the superheat degree is larger than ΔTs; proceeding to S10*b* in a case that the superheat degree of the outlet of the evaporator is smaller than ΔTs.

S06 may include determining, by the controller 22, whether a discharge temperature of the compressor detected by a thermocouple 104 is smaller than a set value T2; proceeding to S07 in a case that the discharge temperature of the compressor is smaller than the set value T2; proceeding to S09 in a case that the discharge temperature of the compressor is not smaller than the set value T2.

S07 may include obtaining, by the controller 22, absolute moisture contents of the inlet air and the outlet air of the roller according to measured values from the temperature and humidity sensors 102 and 103; determining whether a difference between the absolute moisture contents of the inlet air and the outlet air of the roller is smaller than a set value Δd; proceeding to S04 in a case that the difference between the absolute moisture contents of the inlet air and the outlet air of the roller is not smaller than the set value Δd; stopping the compressor in a case that the difference between the absolute moisture contents of the inlet air and the outlet air of the roller is smaller than the set value Δd, and stopping the air blower and the roller drive unit after the compressor has been stopped for a period of time t2.

S08 may include determining, by the controller 22, whether a rotational speed of the compressor has reached a minimum effective rotational speed; lowering the rotational speed of the compressor in a case that the rotational speed has not reached the minimum effective rotational speed, and proceeding to S04 after the operation is stable; proceeding to S09 in a case that the rotational speed of the compressor has reached the minimum effective rotational speed. Wherein, a value of the rotational speed of the compressor to be reduced may be stored in the system program, or may be calculated by the controller according to the system operation condition.

S09 may include stopping the compressor, and running the compressor after a period of time t1 elapses, and proceeding to S06.

S10*a* may include determining, by the controller 22, whether an opening of the expansion valve has reached a maximum limit value; proceeding to S06 in a case that the opening of the expansion valve has reached the maximum limit value; increasing the opening of the electronic expansion valve in a case that the opening of the expansion valve has not reached the maximum limit value, and then proceeding to S05. The maximum limit value of the opening of the electronic expansion valve herein refers to an opening of the electronic expansion valve that enables the superheat degree to be greater than or equal to 0° C. when the compressor operates at each rotational speed. This value may be stored in the controller by experiments.

S10*b* may include determining, by the controller 22, whether the opening of the expansion valve has reached a minimum limit value; proceeding to S06 in a case that the opening of the expansion valve has reached the minimum limit value; reducing the opening of the electronic expansion valve in a case that the opening of the expansion valve has not reached the minimum limit value, and then proceeding to S05. The minimum limit value of the expansion valve may be stored in the controller.

In this solution, the temperature sensor for detecting the temperature of the inlet air of the roller may be positioned in an air duct between the outlet of the condenser of the air circulation system and the inlet of the roller. In addition, a temperature value detected by the temperature and humidity sensor 102 at the inlet of the roller may also be used; the temperature and humidity sensors 102 and 103 for detecting the moisture contents of the inlet air and the outlet air of the roller may be positioned at the inlet and the outlet of the roller respectively, and the temperature sensor 104 for detecting the discharge temperature of the compressor may be positioned at the outlet pipe of the compressor. The superheat degree of the outlet of the evaporator may be obtained according to a temperature difference between the inlet and the outlet of the evaporator or the evaporating temperature of the evaporator, and may be indirectly obtained by the data of a pressure sensor 105 and a temperature sensor 101 which are arranged at the outlet of the evaporator.

Figure 9:
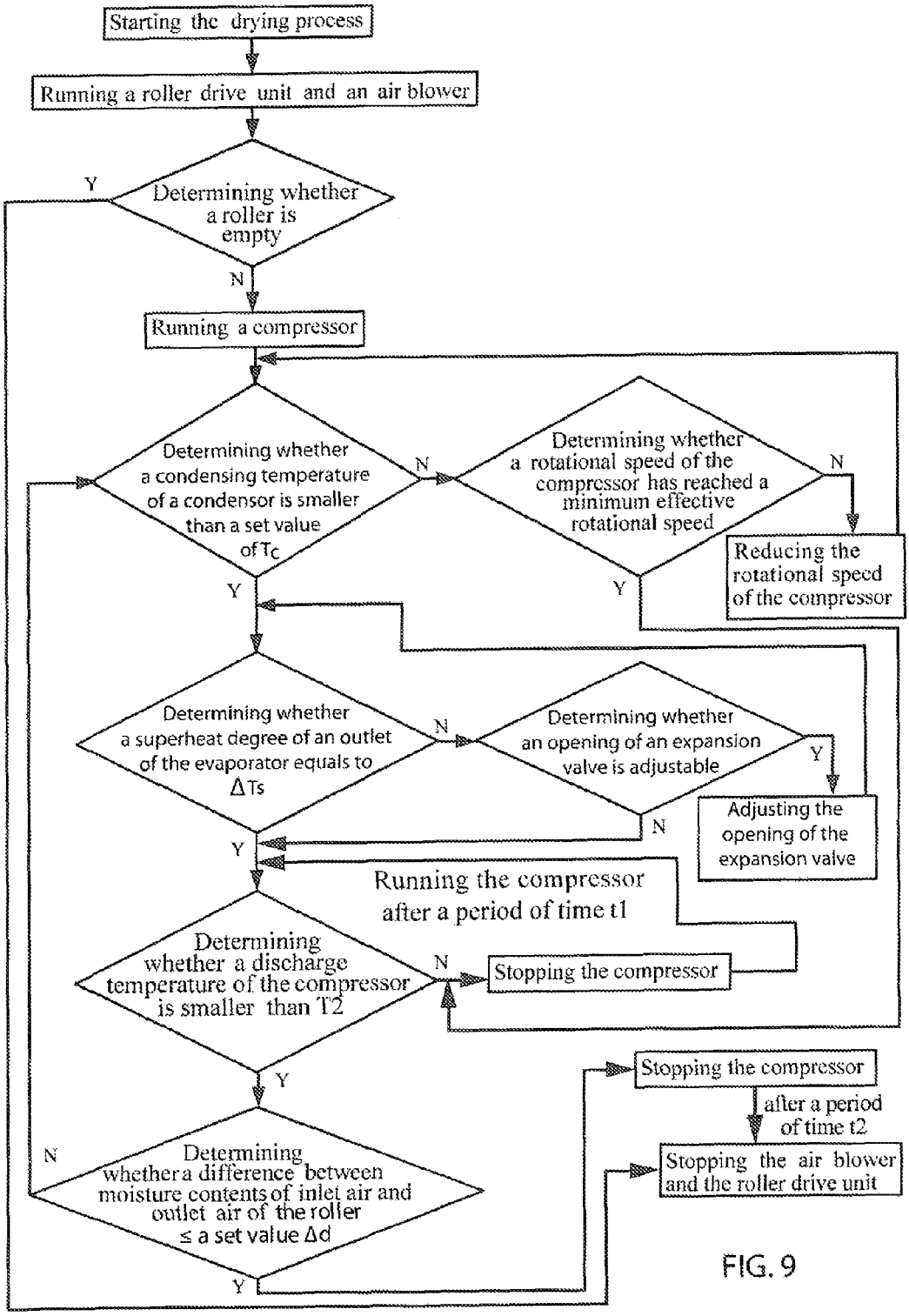
FIG. 9 is another control flow chart of the clothes dryer in the first embodiment, wherein a variable speed compressor and an expansion valve are used in system control.

In the above embodiment, in step S04, the rotational speed of the variable speed compressor is adjusted by directly detecting the temperature of the inlet air of the roller, so as to perform determination and control. In addition, other parameters may also be used to realize the control. For example, in the embodiment shown in FIG. 9, the temperature of the inlet air of the roller is determined and controlled according to the condensing temperature of the condenser, which may also realize the control. In this case, the temperature sensor may be positioned on an outer wall surface of the middle part of the condenser. In the step S04 of the control flow, the determination of "whether the temperature of the inlet air of the roller is smaller than a set value" is changed to the determination of "whether the condensing temperature of the condenser is smaller than Tc", and the flow chart is shown in FIG. 9. A range of Tc is 50° C.≤Tc≤75° C., and preferably, 55° C.≤Tc≤70° C.

S04' may include determining, by the controller 22, whether the condensing temperature of the condenser detected by a thermocouple is smaller than Tc; proceeding to S05 in a case that the condensing temperature of the condenser is smaller than Tc; proceeding to S08 in a case that the condensing temperature of the condenser is not smaller than Tc.

Figure 10:
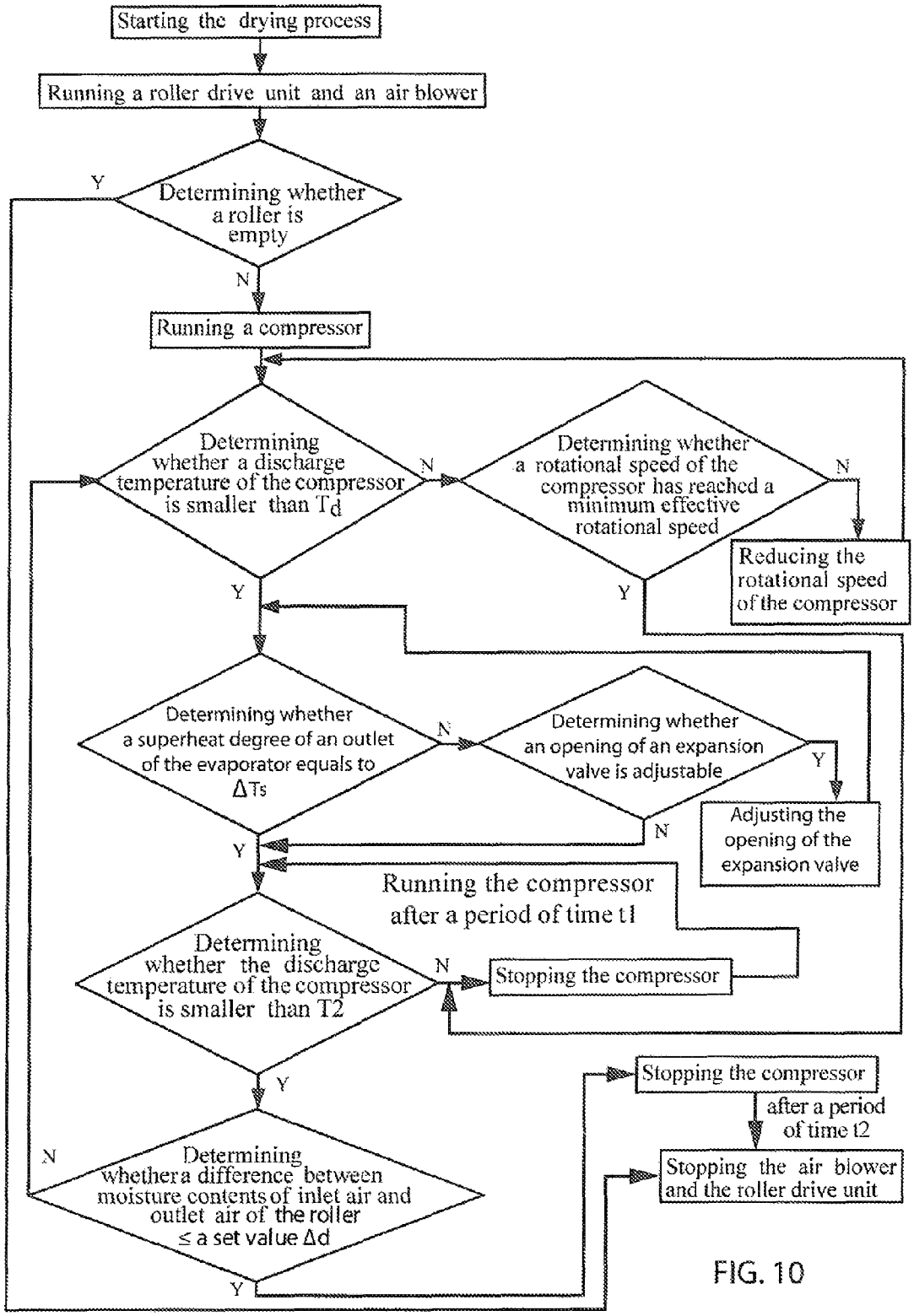
FIG. 10 is another control flow chart of the clothes dryer in the first embodiment, wherein a variable speed compressor and an expansion valve are used in system control.

In addition, in the step S04 of the above embodiment, the temperature of the inlet air of the roller may be indirectly controlled by the discharge temperature of the compressor, and in this case, the temperature sensor may be positioned at the outlet pipe wall of the compressor. In the above control process, the determination of "whether the temperature of the inlet air of the roller is smaller than a set value T1" in the step S04 is changed to the determination of "whether the discharge temperature of the compressor is smaller than Td" in step S04", and the flow chart is shown in FIG. 10. A range of Td is 75° C.≤Td≤120° C., and preferably, 85° C.≤Td≤95° C.

S04" may include determining, by the controller 22, whether the discharge temperature of the compressor detected by the thermocouple is smaller than Td; proceeding to S05 in a case that the discharge temperature of the compressor is smaller than Td; proceeding to S08 in a case that the discharge temperature of the compressor is not smaller than Td.

Figure 12:
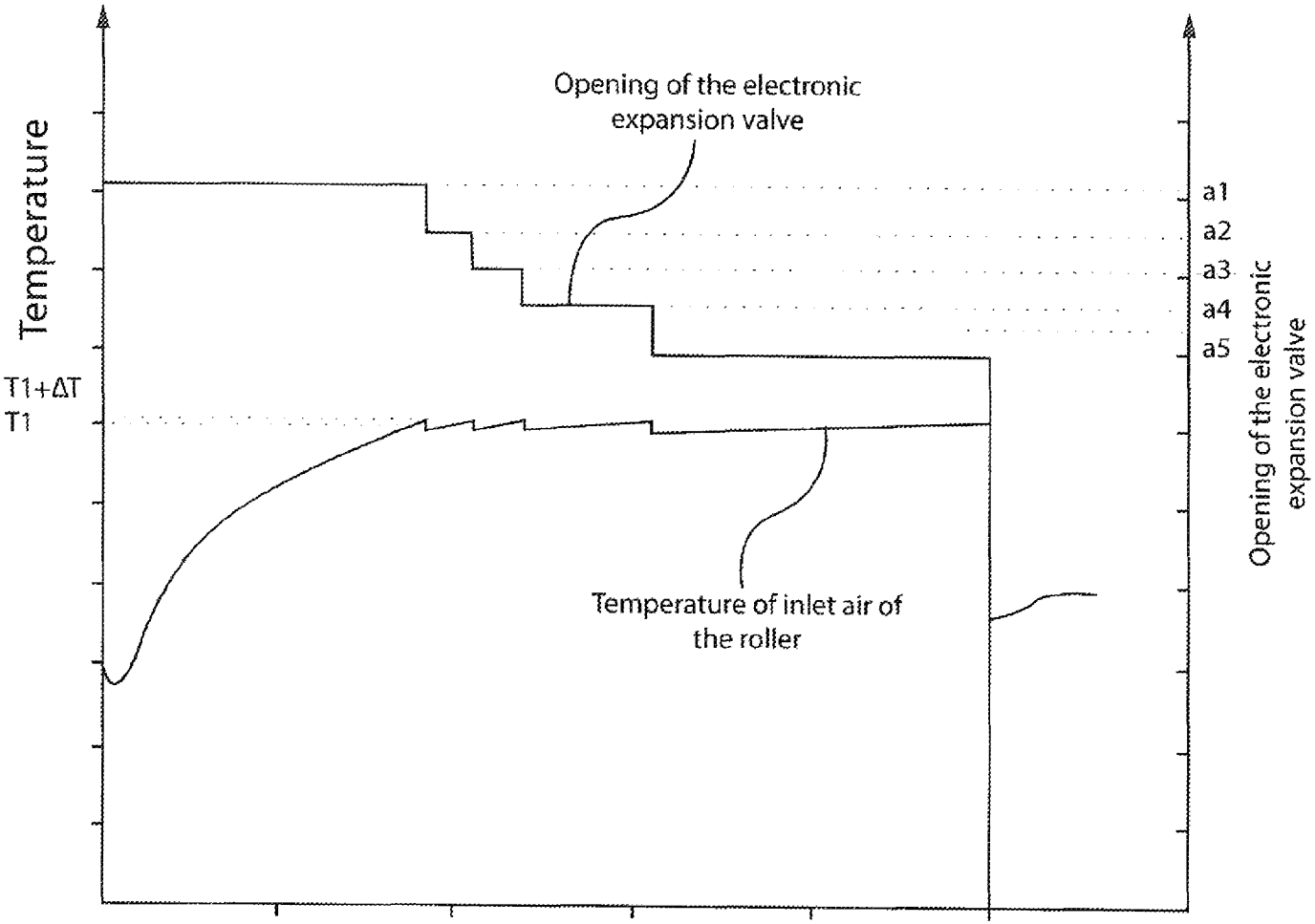
FIG. 12 is a schematic view of parameters of the clothes dryer in the operation according to a second embodiment.
Figure 13:
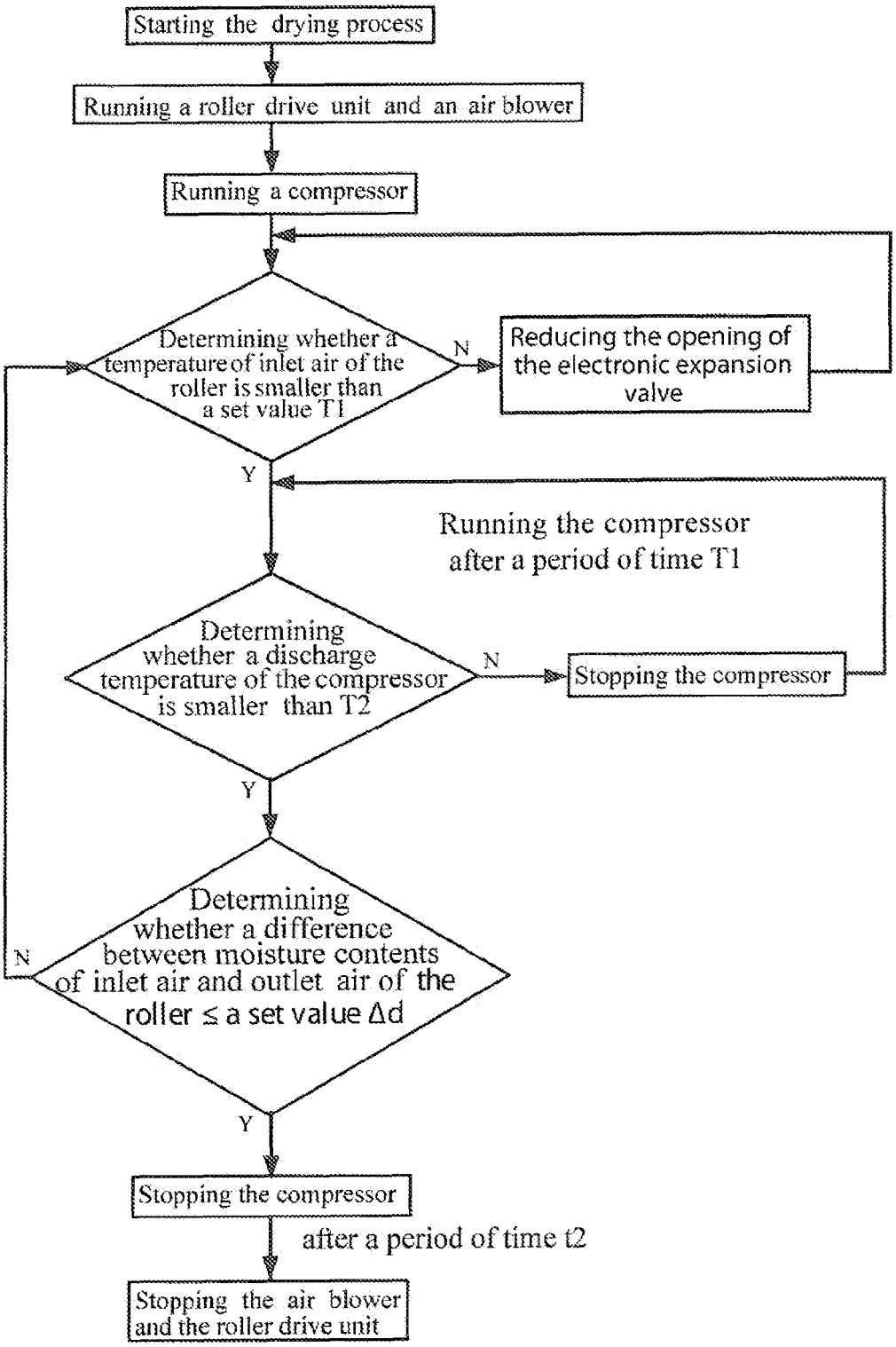
FIG. 13 is a control flow chart of the clothes dryer according to a third embodiment.
Figure 14:
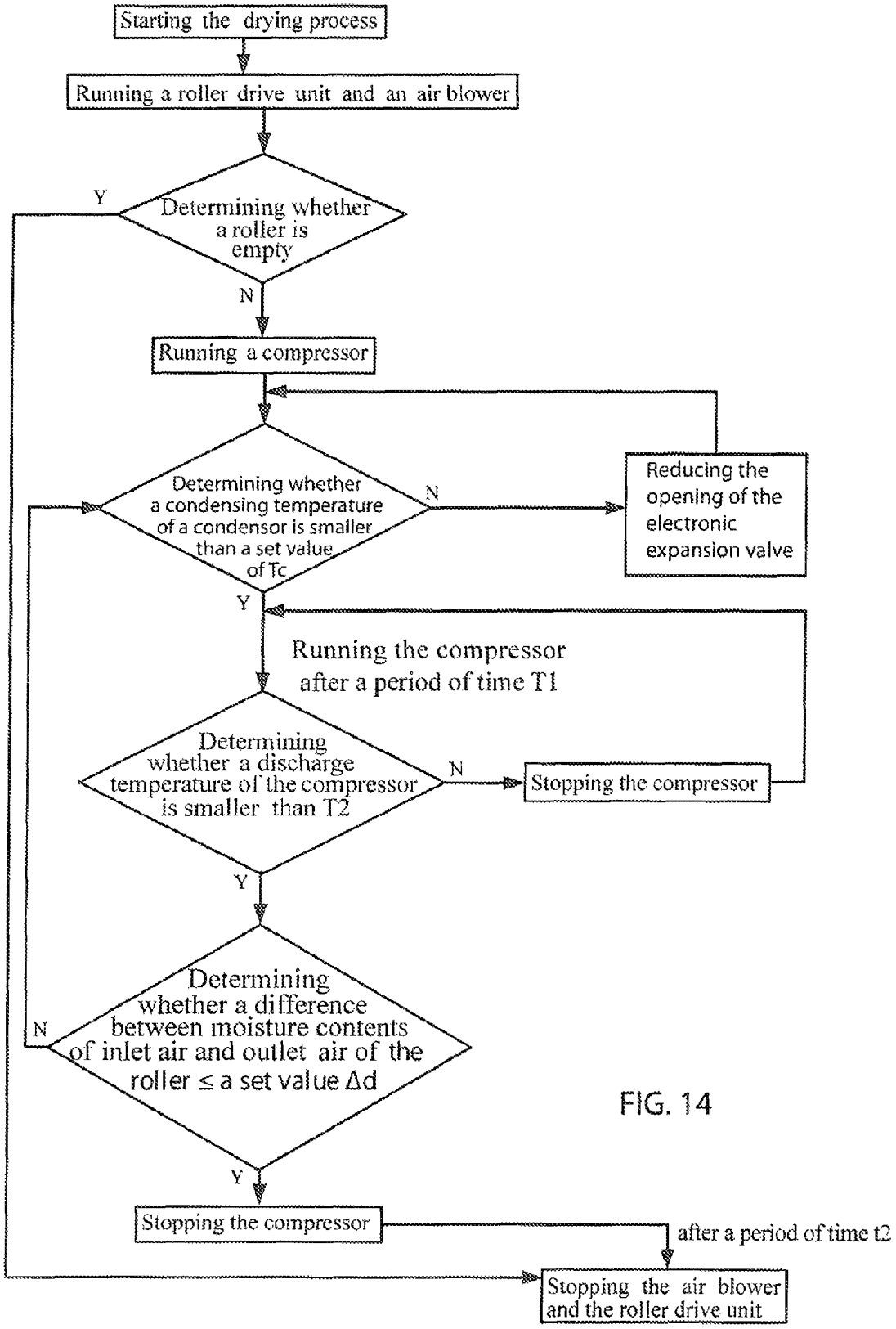
FIG. 14 is another control flow chart of the clothes dryer according to the third embodiment.

In the above technical solution, the compressor is a variable speed compressor; the above solution may also be replaced by the following technical solution, that is, a normal fixed-frequency compressor is used, and an adjustable expansion valve, such as an electronic expansion valve, is used to control the flow of the refrigerant, thus, the temperature rise phase and the drying phase of the clothes dryer are both adjustable and controllable. Reference is made to FIG. 12, FIG. 13 and FIG. 14, which are schematic views of two control processes of the clothes dryer using the normal compressor. The opening of the electronic expansion valve may be adjusted according to the temperature of the inlet air of the roller, for example, when the temperature of the inlet air of the roller is greater than a set temperature, the opening of the electronic expansion valve is reduced, which reduces the mass flow of the refrigerant, thus the refrigerant entering into the compressor is reduced, which reduces the energy consumption of the compressor, and reduces the pressure and temperature of the outlet of the compressor. In this way, the heating quantity for the air provided by the condenser is also reduced, which reduces the temperature of the inlet air of the roller, and also reduces the power consumption of the compressor. FIG. 12 is a schematic view showing the impact on the temperature of the inlet air of the roller when the opening of the electronic expansion valve is gradually increased, wherein reference numerals a1, a2, a3, a4, and a5 indicate opening values of the electronic expansion valve, and wherein a1>a2>a3>a4>a5. Impacts caused by other parameters may be referred to FIG. 4. In the temperature rise phase I, the opening of the electronic expansion valve is a maximum opening. The maximum opening herein may not be the maximum opening that the electronic expansion valve is able to reach, but is an appropriate opening calibrated for the electronic expansion valve such that the temperature of the system may be raised rapidly, and the system may operate stably and reliable. This maximum opening may be stored in the controller through system experiments. In addition, the maximum opening may also have a variable range, which may be obtained through calculation of a program stored in the controller. When the temperature of the inlet air of the roller is around a set value T1, for example, T1+ΔT, the opening of the electronic expansion valve is reduced, and the temperature of the inlet air of the roller may be reduced in a short period. As the drying process continues, the temperature of the inlet air of the roller may still be increased, and when the temperature of the inlet air of the roller has reached the set value T1+ΔT or T1+ΔT2 again, the opening of the electronic expansion valve is continued to be reduced. In this way, an effective control is achieved, and finally, the temperature of the inlet air of the roller may be controlled. The temperature of the inlet air of the roller, i.e., the roller of the clothes dryer, may be effectively controlled by adjusting the opening of the electronic expansion valve in the above manner, and compared to the conventional heat pump clothes dryer using a fixed-frequency compressor, the following components, such as the capillary, the filter generally used in combination with the capillary and the subcooler, may be omitted. The subcooler generally refers to an auxiliary heat exchanger assisting to reduce the temperature of the refrigerant in the refrigerant circulation system, and is generally positioned downstream of the condenser in the refrigerant circulation system, and the subcooler is not involved in the air circulation system of the clothes dryer. The present application does not require a subcooler to dissipate heat to control the temperature of the inlet air or the heating quantity entering into the roller, thus the present application may reduce energy waste and facilitate improving the energy utilization rate. Herein, 0° C.≤ΔT, ≤T2≤5° C.

When the opening of the electronic expansion valve is reduced to a certain value, the superheat degree of the outlet of the evaporator may be increased, and the discharge temperature of the compressor may also be increased. However, the total heat quantity transferred to the condenser would not be increased. The control process generally includes the following steps.

S001 may include starting the clothes dryer and running a roller drive unit and an air blower.

S002 may include running a compressor.

S003 may include determining, by a controller 22, whether a temperature value of inlet air of the roller is smaller than a set value T1 or T1+ΔT, wherein the temperature value of the inlet air of the roller is detected by a temperature sensor or a temperature and humidity sensor 102; proceeding to step S004 in a case that the temperature value of the inlet air of the roller is smaller than the set value T1 or T1+ΔT; proceeding to step S007 in a case that the temperature value of the inlet air of the roller is not smaller than the set value T1 or T1+ΔT.

S004 may include determining, by the controller 22, whether a discharge temperature of the compressor is smaller than a set value T2, wherein the discharge temperature of the compressor is detected by a temperature sensor 104; proceeding to step S005 in a case that the discharge temperature of the compressor is smaller than the set value T2; proceeding to S008 in a case that the discharge temperature of the compressor is not smaller than the set value T2.

S005 may include determining, by the controller 22, whether a difference of moisture content is smaller than a set value Δd, wherein the difference of moisture content is a difference between absolute moisture contents of the inlet air and the outlet air of the roller which are detected by temperature and humidity sensors 102 and 103; proceeding to step S006 in a case that the difference of moisture content is smaller than the set value Δd; and proceeding to step S003 in a case that the difference of moisture content is not smaller than the set value Δd.

S006 may include stopping the compressor, and stopping the air blower after the compressor has been stopped for a period of time t2, and stopping rotation of the roller.

S007 may include reducing the opening of the electronic expansion valve, and then proceeding to Step S004.

S008 may include stopping the compressor, and re-starting the compressor after the compressor has been stopped for a period of time t1, and then proceeding to Step S004.

In the drying phase, the opening of the electronic expansion valve is adjusted according to the temperature difference between the actual temperature T0 of the inlet air of the roller and the set value T1. The adjustment range should be accordingly increased as the temperature difference increases, for example:

when the value of T0 minus T1 ranges from 0° C. to 2° C., the opening of the electronic expansion valve remains unchanged;

when the value of T0 minus T1 ranges from 2° C. to 5° C., the adjustment range of the opening of the electronic expansion valve is 1% to 10% of the full opening of the electronic expansion valve;

when the value of T0 minus T1 ranges from 6° C. to 10° C., the adjustment range of the opening of the electronic expansion valve is 10% to 30% of the full opening of the electronic expansion valve;

when the value of T0 minus T1 is greater than 10° C., the system indicates an error, and the system is stopped; and when T0 is smaller than T1, the current opening of the electronic expansion valve remains unchanged.

After each adjustment, the controller processes the received temperature signal and pressure signal at an interval of 0.5 s to 5 s (preferably, the interval ranges from 1 s to 3 s) and provides a feedback, to determine whether the system is in a stable state. A duration required for the stable state may be stored in the system by system experiments, and preferably, the duration ranges from 2 s to 30 s. A second adjustment and determination may be made after the system is stable.

In this technical solution, the temperature sensor, such as the thermocouple, may be positioned on a pipe wall at a rear position in the flow path of the condenser, the temperature and humidity sensors 102 and 103 for detecting the moisture contents of the inlet air and the outlet air of the roller may be arranged at the inlet and the outlet of the roller, respectively; and the temperature sensor 104 for detecting the discharge temperature of the compressor may be positioned at the outlet of the compressor. In the above control process, a range of T1 is 50° C.≤T1≤70° C., a range of T2 is 90° C.≤T2≤100° C., a range of a duration t1 that the compressor is not working is 1 min≤t1≤5 min, and a range of the period t2 is 1 min≤t2≤5 min. These parameters may be stored in the controller through experiments performed according to the operating conditions. The difference Δd of the moisture contents between the inlet air and the outlet air of the roller may be selected according to a drying degree. For example, the drying degrees of the clothes to be ironed or not after drying are different, thus the standards for determining whether the drying process should be stopped are also different. The adjustment of the opening of the electronic expansion valve is to gradually reduce the opening. The opening of the electronic expansion valve in the temperature rise phase is greater than the opening of the electronic expansion valve in the drying phase. As the opening of the electronic expansion valve increases, the mass flow of the refrigerant accordingly increases, the power consumption of the compressor is also accordingly increased, and the superheat degree of the outlet of the evaporator is accordingly reduced. The superheat degree ΔTs of the outlet of the evaporator has to be greater than 0° C. for preventing the liquid phase refrigerant from entering into the compressor. A maximum value of the opening of the electronic expansion valve may be determined through system experiments and then stored in the controller, alternatively, a pressure sensor and a temperature sensor may be arranged on the outlet pipe of the evaporator to measure the superheat degree of the outlet of the evaporator, and then the maximum value of the opening of the electronic expansion valve may be calculated by a program stored in the controller. Preferably, 55° C.≤T1≤65° C., 95° C.≤T2≤100° C., 2 min≤t2≤4 min, and 2 min≤t2≤4 min. A preferable range of the opening of the electronic expansion valve in the temperature rise phase is a range of the opening when a range of the superheat degree of the outlet of the evaporator is 0<ΔTs≤5° C.

The above control method may effectively reduce the energy waste to a great extent, and also reduce the number of the components of the clothes dryer and reduce the cost. In the above solution, the opening of the electronic expansion valve is controlled by directly detecting the temperature of the inlet air of the roller. In addition, the temperature of the inlet air of the roller may also be controlled indirectly by detecting the condensing temperature of the condenser. The temperature sensor may be positioned on the outer wall surface at a middle of the condenser or the pipe wall surface at a rear position of the condenser, as shown in FIG. 14. The determination of "whether the temperature of the inlet air of the roller is smaller than the set value T1" in the control process S003 in FIG. 13 is changed to the determination of "whether the condensing temperature of the condenser is smaller than Tc" in S003', and the corresponding flow chart is shown in FIG. 14. Herein, a range of Tc is 50° C.≤Tc≤75° C., preferably, 55° C.≤Tc≤70° C. The determination of "whether the temperature of the inlet air of the roller is smaller than the set value T1" in the control process S003 is changed to the determination of "whether the discharge temperature of the compressor is smaller than Td", wherein, a range of Td is 75° C.≤Td≤120° C., and preferably, 85° C.≤Td≤95° C. In addition, a determination of whether there are objects in the clothes dryer may be added before the compressor operates, and reference may be made to the flow chart shown in the figure.

In addition, in the above embodiment, the parameter for determining whether the drying process should be ended may also be a relative moisture value of the outlet air of the roller. The determination of "whether the difference of moisture contents between the inlet air and the outlet air of the roller is smaller than the set value Δd" in Step S005 of the control process in FIG. 13 is changed to the determination of "whether the relative moisture value of the outlet air of the roller is smaller than H". Control may be performed according to the various required drying degrees of the clothes to be dried. The relative moisture value of the outlet air of the roller may be selected according the type of the clothes to be dried or the type of the drying process.

In the above embodiment, the parameter for determining whether the drying process should be ended may also be directly detected and determined by a moisture tester. The moisture tester may be mounted inside the roller to directly measure the moisture content of the clothes. The determination of "whether the difference of moisture contents between the inlet air and the outlet air of the roller is smaller than the set value Δd" in Step S005 of the control process in FIG. 13 is changed to the determination of "whether the moisture content inside the roller is smaller than a set value ΔW". Also, the moisture content may be selected according to various processing requirements of the clothes after being dried.

It should be noted that, the above embodiments are only intended for describing the technical solutions of the present application, and should not be interpreted as limitation to the present application. Although the present application is described in detail in conjunction with the above embodiments, it should be understood that, for those skilled in the art, modifications or equivalent substitutions may be made to the present application; and all technical solutions and the improvements thereof without departing from the spirit and scope of the present application are deemed to fall into the scope of the present application defined by the claims.

The invention claimed is:

1. A clothes dryer, comprising an air circulation system and a refrigerant circulation system, the refrigerant circulation system comprising a compressor, a condenser, a throttling element and an evaporator; the air circulation system comprising a filter device, an air circulation power fan for supplying power of air circulation of the air circulation system, and a roller for accommodating objects to be dried;

wherein, the condenser is configured to provide heat quantity required for drying, to the roller, and before air in an air duct of the air circulation system enters into the roller, exchanges heat with the air when the air passes through the condenser; the clothes dryer further comprises a controller, a temperature sensor or a temperature-sensing element, and a temperature and humidity sensing element; the controller is configured to control an operation of the clothes dryer, which comprises controlling an operating condition of the refrigerant circulation system; the operation of the clothes dryer comprises a temperature rise phase and a basic drying phase, and the compressor of the clothes dryer is configured to have a higher power consumption in the temperature rise phase than in the basic drying phase.

2. The clothes dryer according to claim 1, wherein the compressor is a variable speed compressor, the compressor of the clothes dryer has a higher rotational speed in the temperature rise phase than in the basic drying phase, and the rotational speed of the compressor operating in the temperature rise phase is a maximum value of the rotational speed of the compressor in the operation of the clothes dryer.

3. The clothes dryer according to claim 2, wherein the basic drying phase is a phase that a humidity of outlet air of the roller is relatively stable after the temperature rise phase, the operation of the clothes dryer further comprises a post-drying phase to be operated after the basic drying phase, the basic drying phase and the post-drying phase are differentiated according to the humidity or a change rate of the humidity of the outlet air of the roller, the outlet air has a higher humidity in the basic drying phase than in the post-drying phase, or, when the clothes dryer enters into the post-drying phase after the basic drying phase, the changing rate of the humidity of the outlet air is increased; and the rotational speed of the compressor in the basic drying phase is greater than or equal to that in the post-drying phase.

4. The clothes dryer according to claim 2, wherein the controller is in signal communication with at least one of a temperature sensor or a temperature and humidity sensor for detecting a temperature of inlet air of the roller, a condensing temperature sensor for detecting a condensing temperature of the condenser, and a temperature sensor for detecting a discharge temperature of the compressor, and the controller is configured to control the rotational speed of the compressor according to the temperature of the inlet air of the roller, a condensing temperature of the condenser, or the discharge temperature of the compressor.

5. The clothes dryer according to claim 4, wherein the throttling element is a thermal expansion valve, an electronic expansion valve, or other types of throttling elements.

6. The clothes dryer according to claim 2, wherein the controller is in signal communication with at least one of a temperature sensor or a temperature and humidity sensor for detecting a temperature of inlet air of the roller, a condensing temperature sensor for detecting a temperature of the condenser, and a temperature sensor for detecting a discharge temperature of the compressor, and the controller is configured to control the rotational speed of the compressor according to the temperature of the inlet air of the roller, a condensing temperature of the condenser, or the discharge temperature of the compressor; and the throttling element is an electronic expansion valve, and the controller is in signal communication with a temperature sensor for detecting an outlet air temperature of the evaporator and a pressure sensor for detecting an evaporating pressure of the evaporator, or is in signal communication with a temperature sensor for detecting an outlet temperature and an evaporating temperature of the evaporator; and in a case that the electronic expansion valve has not reached a limit opening, the opening of the electronic expansion valve is controlled, by the controller, to be increased when a superheat degree of the outlet of the evaporator is relatively large, and the opening of the electronic expansion valve is controlled, by the controller, to be reduced when the superheat degree of the outlet of the evaporator is relatively small; or the throttling element is a thermal expansion valve, and a temperature-sensing element for sensing a temperature of an outlet of the evaporator is provided in the thermal expansion valve, and the thermal expansion valve acts according to the temperature of the outlet of the evaporator, to adjust a flow of refrigerant.

7. The clothes dryer according to claim 2, wherein in the temperature rise phase of the clothes dryer, the compressor operates in a fixed rotational speed range, and the fixed rotational speed range is 40% to 98% of an allowable maximum rotational speed of the compressor; in the basic drying phase of the clothes dryer, the rotational speed of the compressor is adjusted according to a temperature difference between an actual temperature (T0) of the inlet air of the roller and a set value (T1), and in a case that the actual temperature (T0) of the inlet air is greater than the set value (T1), an adjustment range of the rotational speed of the compressor increases as the temperature difference (T0−T1) increases, and in a case that the actual temperature (T0) of the inlet air is smaller than the set value (T1), the rotational speed of the compressor remains unchanged.

8. The clothes dryer according to claim 3, wherein in the temperature rise phase of the clothes dryer, the compressor operates in a fixed rotational speed range, and the fixed rotational speed range is 40% to 98% of an allowable maximum rotational speed of the compressor; in the basic drying phase of the clothes dryer, the rotational speed of the compressor is adjusted according to a temperature difference between an actual temperature (T0) of the inlet air of the roller and a set value (T1), and in a case that the actual temperature (T0) of the inlet air is greater than the set value (T1), an adjustment range of the rotational speed of the compressor increases as the temperature difference (T0−T1) increases, and in a case that the actual temperature (T0) of the inlet air is smaller than the set value (T1), the rotational speed of the compressor remains unchanged.

9. The clothes dryer according to claim 5, wherein in the temperature rise phase of the clothes dryer, the compressor operates in a fixed rotational speed range, and the fixed rotational speed range is 40% to 98% of an allowable maximum rotational speed of the compressor; in the basic drying phase of the clothes dryer, the rotational speed of the compressor is adjusted according to a temperature difference between an actual temperature (T0) of the inlet air of the roller and a set value (T1), and in a case that the actual temperature (T0) of the inlet air is greater than the set value (T1), an adjustment range of the rotational speed of the compressor increases as the temperature difference (T0−T1) increases, and in a case that the actual temperature (T0) of the inlet air is smaller than the set value (T1), the rotational speed of the compressor remains unchanged.

10. The clothes dryer according to claim 1, wherein the compressor is a fixed-frequency compressor, and the throttling element is an electronic expansion valve, an opening of the electronic expansion valve is adjusted to enable the compressor of the clothes dryer to have a higher power consumption in the temperature rise phase than in the basic drying phase in which outlet air of the roller has a relatively stable humidity; in the temperature rise phase of the clothes dryer, the controller sends a control signal to the electronic expansion valve, and the control signal requires the electronic expansion valve to have a larger opening than in the basic drying phase of the clothes dryer; in the temperature rise phase, the opening of the electronic expansion valve is the maximum opening in the entire operation of the clothes dryer; and the controller is in signal communication with at least one of a temperature sensor or a temperature and humidity sensor for detecting a temperature of inlet air of the roller, a condensing temperature sensor for detecting a temperature of the condenser, and a temperature sensor for detecting a discharge temperature of the compressor, and the controller is configured to control the opening of the compressor according to the temperature of the inlet air of the roller, a condensing temperature of the condenser, or the discharge temperature of the compressor.

11. The clothes dryer according to claim 1, wherein the filter device is arranged between an air duct coming out of the roller in the air circulation system and the evaporator in the refrigerant circulation system and the evaporator is configured to cool and dehumidify air discharged from the outlet of the roller; and in the refrigerant circulation system, an outlet of the compressor is directly or indirectly connected to an inlet of the condenser by a pipeline, and an outlet of the condenser is directly or indirectly connected to one end of the throttling element by a pipeline, and another end of the throttling element is directly or indirectly connected to the evaporator by a pipeline, and all outlet of the evaporator is directly or indirectly connected to an inlet of the compressor by a pipeline.

12. The clothes dryer according to claim 1, wherein the refrigerant circulation system does not comprise a subcooler which is defined as an auxiliary heat exchanger arranged downstream of the condenser in the refrigerant circulation system and configured to assist to reduce a temperature of refrigerant in the refrigerant circulation system, and the subcooler is arranged outside the air circulation system of the clothes dryer.

13. A control method of a clothes dryer, comprising:

providing a clothes dryer comprising an air circulation system and a refrigerant circulation system, the refrigerant circulation system comprising a compressor, a condenser, a throttling element and an evaporator; the air circulation system comprising a filter device, an air circulation power fan for supplying power of air circulation of the air circulation system, and a roller for accommodating objects to be dried;

wherein, providing the refrigerant circulation system which does not comprise a subcooler; the condenser is configured to provide heat quantity, required for drying, to the roller; the clothes dryer further comprises a controller, a temperature sensor or a temperature-sensing element, and a temperature and humidity sensing element; the controller is configured to control an operation of the clothes dryer, which comprises controlling an operating condition of the refrigerant circulation system; the operation of the clothes dryer comprises a temperature rise phase and a basic drying phase, and the compressor of the clothes dryer is configured to have a higher power consumption in the temperature rise phase than in the basic drying phase;

providing the compressor which is a variable speed compressor, the compressor of the clothes dryer is configured to have a higher rotational speed in the temperature rise phase than in the basic drying phase, to enable the compressor of the clothes dryer to have a higher power consumption in the temperature rise phase than in the basic drying phase; the rotational speed of the compressor operating in the temperature rise phase is a maximum value of the rotational speed of the compressor in the entire operation of the clothes dryer, and the rotational speed of the compressor is substantially unchanged in the temperature rise phase; and in the basic drying phase, the rotational speed of the compressor is controlled, by the controller, according to at least one of a temperature of inlet air of the roller, a condensing temperature of the condenser, and a discharge temperature of the compressor;

or providing the compressor which is a fixed-frequency compressor, and the throttling element is an electronic expansion valve, an opening of the electronic expansion valve is adjusted to enable the compressor of the clothes dryer to have a higher power consumption in the temperature rise phase than in the basic drying phase in which outlet air of the roller has a relatively stable humidity; in the temperature rise phase of the clothes dryer, the controller sends a control signal to the electronic, expansion valve, to require the electronic expansion valve to have a larger opening than in the basic drying phase of the clothes dryer; in the temperature rise phase, the opening of the electronic expansion valve is the maximum opening in the entire operation of the clothes dryer, and in the temperature rise phase, the control signal sending to the electronic expansion valve from the controller requires the electronic expansion valve to have a substantially unchanged opening; and in the basic drying phase, the opening of the electronic expansion valve is controlled, by the controller, according to at least one of a temperature of inlet air of the roller, a condensing temperature of the condenser, and a discharge temperature of the compressor.

14. The control method of the clothes dryer according to claim 13, comprising reducing the rotational speed of the compressor or the opening of the electronic expansion valve in a case that the temperature of the inlet air of the roller is greater than a set value T1; or reducing the rotational speed of the compressor or the opening of the electronic expansion valve in a case that the condensing temperature of the condenser is greater than a set value Tc; or reducing the rotational speed of the compressor or the opening of the electronic expansion valve in a case that the discharge temperature of the compressor is greater than a set value Td.

15. The control method of the clothes dryer according to claim 14, wherein the compressor is a variable speed compressor, and the method comprises:

determining, by the controller, whether a real-time rotational speed of the compressor has reached a set minimum effective rotational speed in a case that the temperature of the inlet air of the roller is greater than the set value T1, or the condensing temperature of the condenser is greater than the set value Tc, or the discharge temperature of the compressor is greater than the set value Td;

reducing the rotational speed of the compressor in a case that the real-time rotational speed of the compressor has not reached the set minimum effective rotational speed, and after the compressor being operated for a period of time, determining whether the temperature of the inlet air of the roller, or the condensing temperature of the condenser or the discharge temperature of the compressor is smaller than the respective set value.

16. The control method of the clothes dryer according to claim 14, wherein the compressor is a variable speed compressor, and the method comprises the following steps in a case that the temperature of the inlet air of the roller, or the condensing temperature of the condenser or the discharge temperature of the compressor is smaller than the respective set value, step 1, determining whether the discharge temperature of the compressor is smaller than a set value T2; proceeding to step 2 in a case that the discharge temperature of the compressor is smaller than the set value T2; proceeding to step 3 in a case that the discharge temperature of the compressor is not smaller than the set value T2;

step 2, obtaining, by the controller, absolute moisture contents of the inlet air and the outlet air of the roller according to measured values from temperature and humidity sensors; determining whether a difference between the absolute moisture contents of the inlet air and the outlet air of the roller is smaller than a set value Δd; proceeding to the step according to claim 14 in a case that the difference between the absolute moisture contents of the inlet air and the outlet air of the roller is not smaller than the set value Δd; stopping the compressor in a case that the difference between the absolute moisture contents of the inlet air and the outlet air of the roller is smaller than the set value Δd, and stopping an air blower and a roller drive unit after the compressor has been stopped for a period of time t2; and step 3, stopping the compressor, and running the compressor after the compressor has been stopped for a period of time t1, and proceeding to the step 1.

17. The control method of the clothes dryer according to claim 16, wherein the throttling element is an expansion valve, and before the step 1 according to claim 16, the method further comprising:

step 01, determining whether a superheat degree of an outlet of the evaporator equals to a set value ΔTs;

proceeding to the step 1 in a case that the superheat degree of the outlet of the evaporator equals to the set value ΔTs; proceeding to step 02 in a case that the superheat degree of the outlet of the evaporator is larger than the set value ΔTs; proceeding to step 03 in a case that the superheat degree of the outlet of the evaporator is smaller than the set value ΔTs;

step 02, determining, by the controller, whether an opening of the expansion valve has reached a maximum limit value; proceeding to the step 1 in a case that the opening of the expansion valve has reached the maximum limit value; increasing the opening of the expansion valve in a case that the opening of the expansion valve has not reached the maximum limit value, and then proceeding to step 01; and step 03, determining, by the controller, whether the opening of the expansion valve has reached a minimum limit value; proceeding to the step 1 in a case that the opening of the expansion valve has reached the minimum limit value; reducing the opening of the expansion valve in a case that the opening of the expansion valve has not reached the minimum limit value, and then proceeding to the step 01.

18. The control method of the clothes dryer according to claim 14, wherein the compressor is a fixed-frequency compressor, and the throttling element is an electronic expansion valve, and the method comprises the following steps in a case that the temperature of the inlet air of the roller, or the condensing temperature of the condenser or the discharge temperature of the compressor is smaller than the respective set value;

step 1, determining whether the discharge temperature of the compressor is smaller than a set value T2; proceeding to step 2 in a case that the discharge temperature of the compressor is smaller than the set value T2; proceeding to step 3 in a case that the discharge temperature of the compressor is not smaller than the set value T2;

step 2, obtaining, by the controller, absolute moisture contents of the inlet air and the outlet air of the roller according to measured values from temperature and humidity sensors; determining whether a difference between the absolute moisture contents of the inlet air and the outlet air of the roller is smaller than a set value Δd; proceeding to the step according to claim 14 in a case that the difference between the absolute moisture contents of the inlet air and the outlet air of the roller is not smaller than the set value Δd;

stopping the compressor in a case that the difference between the absolute moisture contents of the inlet air and the outlet air of the roller is smaller than the set value Δd, and stopping an air blower and a roller drive unit after the compressor has been stopped for a period of time t2; and step 3, stopping the compressor, and running the compressor after the compressor has been stopped for a period of time t1, and proceeding to the step 1.

19. The control method of the clothes dryer according to claim 18, comprising:

in a case that the temperature of the inlet air of the roller is greater than the set value T1, reducing the opening of the electronic expansion valve until the temperature of the inlet air of the roller is smaller than the set value T1, and then proceeding to the step 1 according to claim 18; or in a case that the condensing temperature of the condenser is greater than the set value Tc, reducing the opening of the electronic expansion valve until the condensing temperature of the condenser is smaller than the set value Tc, and then proceeding to the step 1; or in a case that the discharge temperature of the compressor is greater than the set value Td, reducing the opening of the electronic expansion valve until the discharge temperature of the compressor is smaller than the set value Td, and then proceeding to the step 1.

* * * * *